US009044663B2

(12) United States Patent
Karlsen

(10) Patent No.: US 9,044,663 B2
(45) Date of Patent: Jun. 2, 2015

(54) SNOWBOARD

(75) Inventor: Jorgen Karlsen, Hovik (NO)
(73) Assignee: HiTurn AS, Raufoss (NO)

( * ) Notice: Subject to any disclaimer, the term of this patent is extended or adjusted under 35 U.S.C. 154(b) by 0 days.

(21) Appl. No.: 13/701,941
(22) PCT Filed: Jun. 7, 2011

(86) PCT No.: PCT/NO2011/000164
§ 371 (c)(1),
(2), (4) Date: Feb. 14, 2013

(87) PCT Pub. No.: WO2011/155845
PCT Pub. Date: Dec. 15, 2011

(65) Prior Publication Data

US 2013/0154237 A1 Jun. 20, 2013

(30) Foreign Application Priority Data

Jun. 7, 2010 (NO) ..... 20100817
Jun. 6, 2011 (NO) ..... 20110815

(51) Int. Cl.
*A63C 5/00* (2006.01)
*A63C 5/03* (2006.01)
(Continued)

(52) U.S. Cl.
CPC ..... *A63C 5/03* (2013.01); *A63C 5/0405* (2013.01); *A63C 5/0422* (2013.01); *A63C 5/052* (2013.01)

(58) Field of Classification Search
USPC ..... 280/601, 609, 87.042, 602, 14.21, 280/14.22, 610, 607
See application file for complete search history.

(56) References Cited

U.S. PATENT DOCUMENTS 2,065,179 A * 12/1936 Fosse ..... 280/610
2,526,137 A * 10/1950 Hunt ..... 280/610
(Continued)

FOREIGN PATENT DOCUMENTS

EP 1 864 696 A1 12/2007
EP 2 082 787 A1 7/2009
(Continued)

OTHER PUBLICATIONS

International Search Report for corresponding International Patent Application No. PCT/NO2011/000164 mailed Sep. 29, 2011.
(Continued)

*Primary Examiner* — Hau Phan
(74) *Attorney, Agent, or Firm* — Merchant & Gould P.C.

(57) ABSTRACT

The present invention is based on the combination of a snowboard with a 3-dimensional sole which wholly or partly has a tripartite sliding surface in the portion between the transition to the tip(s) and the binding fastening(s), in addition to which the board is equipped with an additional special 3-dimensional geometry in the tip(s), in order to continue the existing uplift in the lateral sliding surface (5), thereby ensuring better uplift and thus better glide and greater speed in loose snow, a combination which provides quite unique riding characteristics. The tip of the snowboard is designed in such a manner that it presses the snow under the board more efficiently, lifting it further up from the snow than an ordinary tip. When riding straight ahead, this is best accomplished by using what is called here a skate plate, with an almost straight portion in the tip, providing an extended tip at a moderate angle to the surface and thereby extremely careful treatment of the snow while keeping the tip above the snow. When turning, an improved uplift in the tip is achieved by successively increasing the angle between the central sole surface (2) and the lateral sole surface (6) in the tip from the end of the sliding surface a few cm forwards in the tip, with the result that during edging the lateral sole surface lies substantially flatter against the snow further forward in the tip than at the transition to the tip, thereby more efficiently pressing the snow under the snowboard and not to the side, thus causing the board to also glide better during turning.

12 Claims, 13 Drawing Sheets

Figure 1:
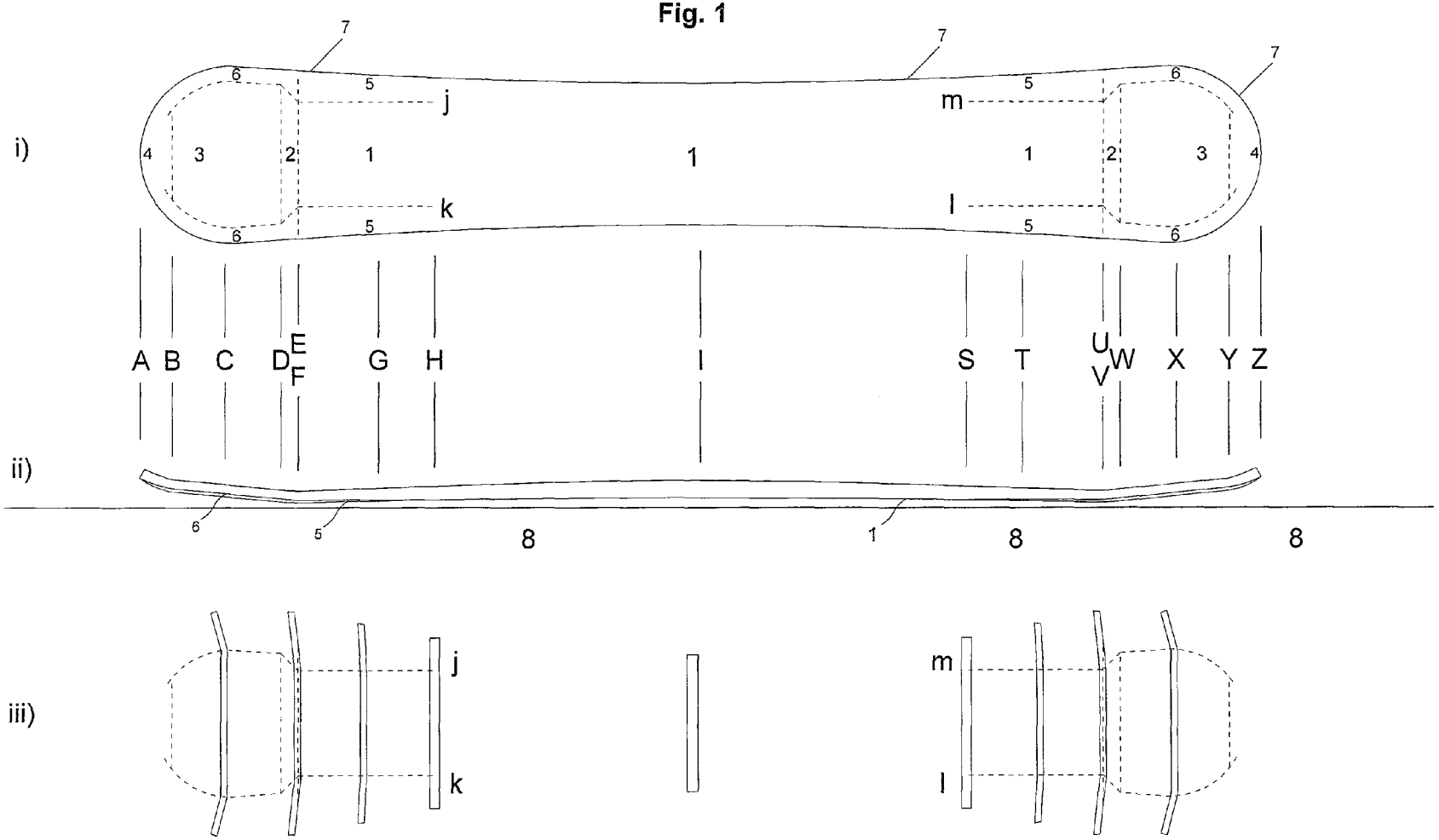

(51) Int. Cl.
*A63C 5/04* (2006.01)
*A63C 5/052* (2006.01)

(56) References Cited

U.S. PATENT DOCUMENTS

| | | | | | |
|---|---|---|---|---|---|
| 3,212,787 | A | | 10/1965 | Werntz | |
| 3,332,697 | A | | 7/1967 | Hagen | |
| 5,186,777 | A | * | 2/1993 | Perenon et al. | 280/610 |
| 5,695,209 | A | * | 12/1997 | Deborde et al. | 280/610 |
| 5,855,389 | A | * | 1/1999 | Andrus et al. | 280/602 |
| 6,293,567 | B1 | * | 9/2001 | Menges | 280/14.21 |
| 6,494,467 | B1 | * | 12/2002 | Menges | 280/14.21 |
| 6,499,758 | B1 | * | 12/2002 | Fournier | 280/609 |
| 6,663,137 | B2 | * | 12/2003 | Karlsen | 280/609 |
| 7,798,514 | B2 | * | 9/2010 | Canaday et al. | 280/609 |
| 8,419,043 | B2 | * | 4/2013 | Fournier | 280/607 |
| 8,465,032 | B2 | * | 6/2013 | Hill et al. | 280/87.042 |
| 2002/0195780 | A1 | | 12/2002 | Karlsen | |
| 2009/0256333 | A1 | | 10/2009 | Canaday et al. | |

FOREIGN PATENT DOCUMENTS

| | | | |
|---|---|---|---|
| JP | 3-140415 | U | 3/2008 |
| JP | 2011/010762 | A | 1/2011 |
| WO | WO 99/46016 | A1 | 9/1999 |
| WO | WO 2006/075918 | | 7/2006 |
| WO | WO 2006/075919 | A1 | 7/2006 |
| WO | WO 2007/094690 | A2 | 8/2007 |
| WO | WO 2012/169896 | | 12/2012 |

OTHER PUBLICATIONS

Norwegian Search Report for corresponding Norwegian Patent Application No. 20100817 mailed Nov. 17, 2010.

Norwegian Search Report for corresponding Norwegian Patent Application No. 20110815 mailed Nov. 14, 2011.

Ride Snowboards, Mailkorrespondence, Jason Ford Promodel, 1994, figurer.

Extended European Search Report for corresponding European Patent Application No. 11792721.0 mailed Feb. 18, 2015.

* cited by examiner

SNOWBOARD

This application is a National Stage Application of PCT/NO2011/000164, filed 7 Jun. 2011, which claims benefit of Serial No. 20100817, filed 7 Jun. 2010 in Norway and Serial No. 2011/0815, filed 6 Jun. 2011 in Norway and which applications are incorporated herein by reference. To the extent appropriate, a claim of priority is made to each of the above disclosed applications.

FIELD OF THE DISCLOSURE

The present invention relates to a snowboard, consisting of a board on which two bindings are mounted on the surface of the board at a distance apart approximately corresponding to ⅓ of the length of the board. The board is provided with inwardly curved edge portions, the board having a greater width at both ends at the transition to the tips than at its narrowest point. The board is assumed to have a sliding surface with a 3-dimensional sole where the steel edges are lifted relative to the flat sole in a very particular manner, this then being combined with tips with a very special geometry and function. The invention is based on the combination of a snowboard with a 3-dimensional sole which wholly or partly has a tripartite sliding surface in the portion between the transition to the tips and the binding fastenings, in addition to which the board is equipped with an additional particular 3-dimensional geometry in the tips, altogether providing quite unique riding characteristics.

BACKGROUND

Today's snowboards are usually designed with a flat sole surface between the tips at the two ends. For manoeuvring, the board is edged and the weight is distributed from the two bindings on the steel edges between the two transitions to the tips.

From Norwegian patent application no. 981056 a snowboard is known which has a sole divided wholly or partly into three sliding surfaces. The object of this invention is to provide the best possible dynamic when riding the board on snow. However, it is apparent from the patent that the uplift does not increase substantially into the tip, nor does it have any other specially prescribed geometry in the tip than the phase-out of the tripartite geometry which is in the sliding surface.

SUMMARY

The present invention is based on the desire to combine the properties of a snowboard which in the sliding surface towards the transition to the tips has an increasing uplift of the steel edges relative to a plane defined in the middle of the board, where the tip is designed so as to provide extra good functionality in deep snow and on soft surfaces in general. This is achieved by designing the tip in such a manner that it presses the snow under the board more efficiently, lifting it further up from the snow than an ordinary tip. When riding straight ahead, this is best accomplished by using what is called here a skate plate, where the skate plate is like an almost straight portion in the snowboard's tip, thus providing an extended tip at a moderate angle relative to the surface and thereby extremely careful treatment of the snow while keeping the tip above the snow. When turning, an improved uplift in the tip is achieved, by increasing the angle between the central sole surface and the lateral sole surface in the tip successively from the end of the sliding surface a few cm forwards in the tip, with the result that during edging the lateral sole surface lies substantially flatter against the snow in the tip than at the transition to the tip, thereby more efficiently pressing the snow under the snowboard and not to the side, thus causing the board to also glide better during turning. In order for this to provide the best possible effect, the upward curve in the lateral sole surface(s) will preferably be increased more rapidly in the tip than in the central sole surface.

A special use for the skate plate is achieved if the snowboard is to be used principally on rails and boxes in parks, but there is also a requirement to retain good riding characteristics for normal riding on the ground. The solution is therefore to integrate a plateau (skate plate) between the ordinary sliding surface (the central sole surface) and the front tip of the snowboard, the point being that when riding or snow, this plateau should function as part of the tip, while during active use of the plateau on rails and boxes and during so-called "buttering" it has a special function as contact surface against the ground when the tricks concerned normally involve use of the front part of the sliding surface.

This differs substantially from today's boards with reversed camber since the front portion is so clearly defined as a part of the nose when riding on snow and only acts as a part of the classic sliding surface when performing special tricks.

The skate plate is a part of a specially-designed tip which consists of a few cm in the longitudinal direction in front of the ordinary sliding surface (central sole surface) where the sole is curved slightly upwards, whereupon an approximately flat portion is provided over a certain length of the tip, with the result that the tip now turns upwards at a substantially uniform angle relative to the sliding surface, although in such a manner that the angle may be slightly varied, but it substantially provides a sole piece which is functionally approximately flat. This is followed by a short additional tip where the sole is curved upwards to that the angle to the sliding surface increases further. This almost flat portion is called a skate plate and forms a part of the tip when riding on snow, but for certain tricks it functions as a part of the ordinary sliding surface on normal snowboards.

This concept can best be employed with a certain degree of normal camber between a transition E and V in the snowboard. However, it may also be envisaged for use in combination with a snowboard without camber, or even reversed camber in this area.

The design of the tip in order to improve the riding characteristics when the board is flat, and the design of the tip in order to improve the riding characteristics when turning may be employed separately or in combination. In any case the invention assumes that these special functions in the tip are employed together with a dynamic geometrical three-dimensional design of the snowboard's sliding surface, where steel edges are given an essentially increasing uplift relative to the middle of the sliding surface, when viewed in cross section, towards the transition to the tip(s). A further improvement is thereby achieved in dynamic by employing the concept with a specific tripartite sliding surface. The improvements according to the invention are achieved by means of a combination of two or more of the following elements:

- Behind the transition to the tip a sliding surface is employed in the area E-V as described in Norwegian patent application no. 981056 or PCT/NO2006/000014, where in principle the sliding surface is divided into three parts with a flat, central sliding surface and raised sliding surfaces with raised steel edges on each side,
- Against the steel edge of the almost flat skate plate portion, when viewed in cross section, the concept is employed with trisection of the sole surface so that the skate plate portion consists of three parts, comprising a flat and fairly wide central part, and on both sides of the central part out towards the steel edges there are raised sole surfaces giving a geometry which ensures that the steel edges are located higher than the flat skate plate portion when viewed across the board.

Because the tip with the skate plate is first given an extremely moderate upward curve and then a flat portion, the rest of the tip may advantageously be fairly short. To avoid this resulting in problems with a tip which is too small when edging in normal snow, a tripartite sliding surface may advantageously be employed in order to ensure a better tip function, thereby causing the snow to go under the sole and avoiding the edge of the tip cutting too far down into the snow. This is achieved by letting the raised sliding surfaces (lateral sole surfaces) out towards the edges turn progressively upwards from a transition E to C, thereby raising the steel edge relative to the skate plate, at any rate to approximately the middle of the tip.

A tip which has to press as much snow as possible under the snowboard during turning should lie as flat as possible against the snow when the board is edged, when viewed in cross section, but with an upward curve forwards as a tip viewed in the longitudinal direction. Until the angle which the lateral sole surface in the tip forms with the central sole surface is equal to the angle at which the snowboard is tilted during turning, the tip's ability to lift the snowboard out of the snow during turning increases. Since the angle at which the rider tilts the snowboard varies greatly, this places certain limits on how many degrees it is optimal to curve the raised sliding surfaces (the lateral sole surfaces) upwards.

Figure 4:
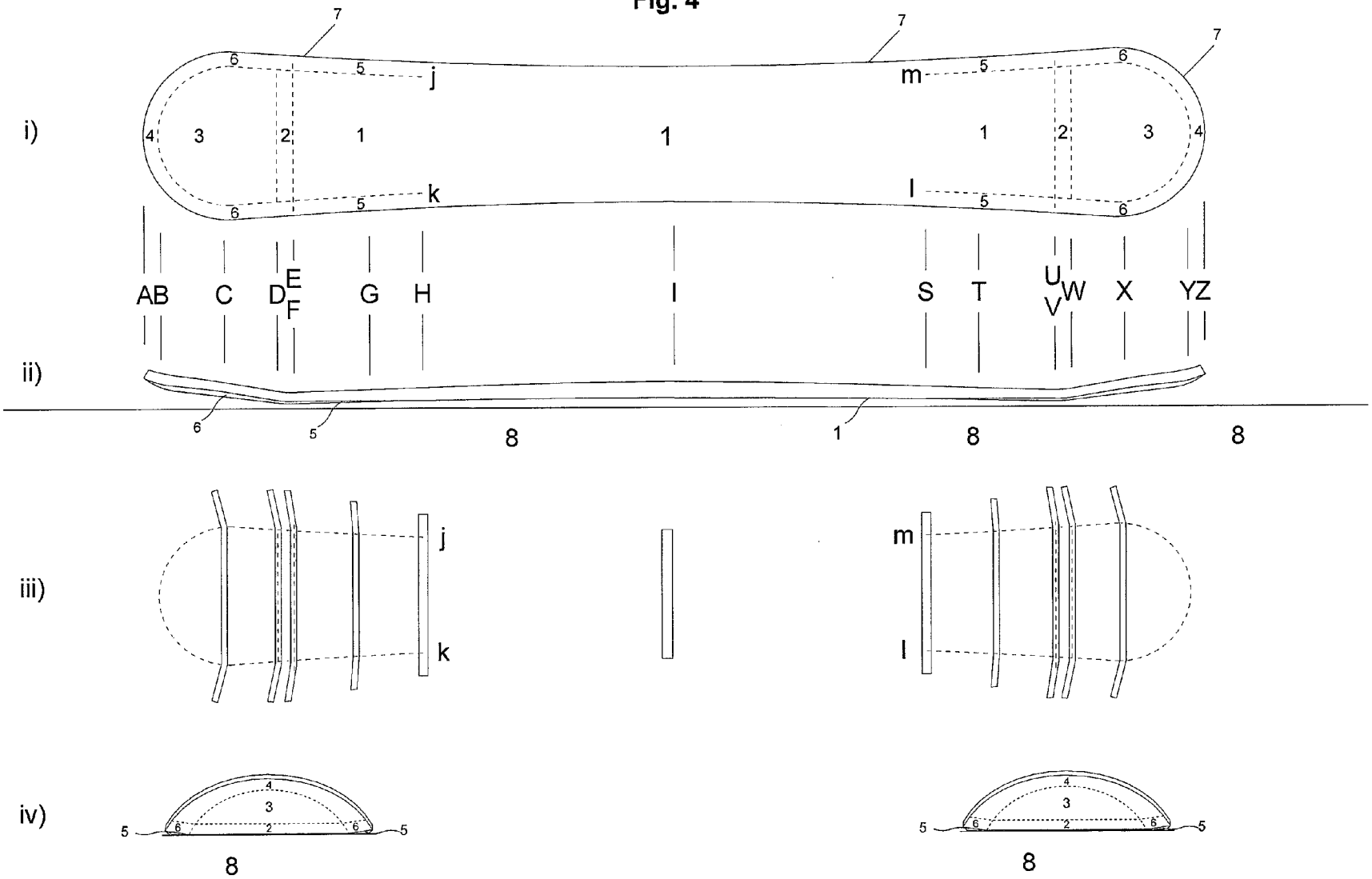
Figure 5:
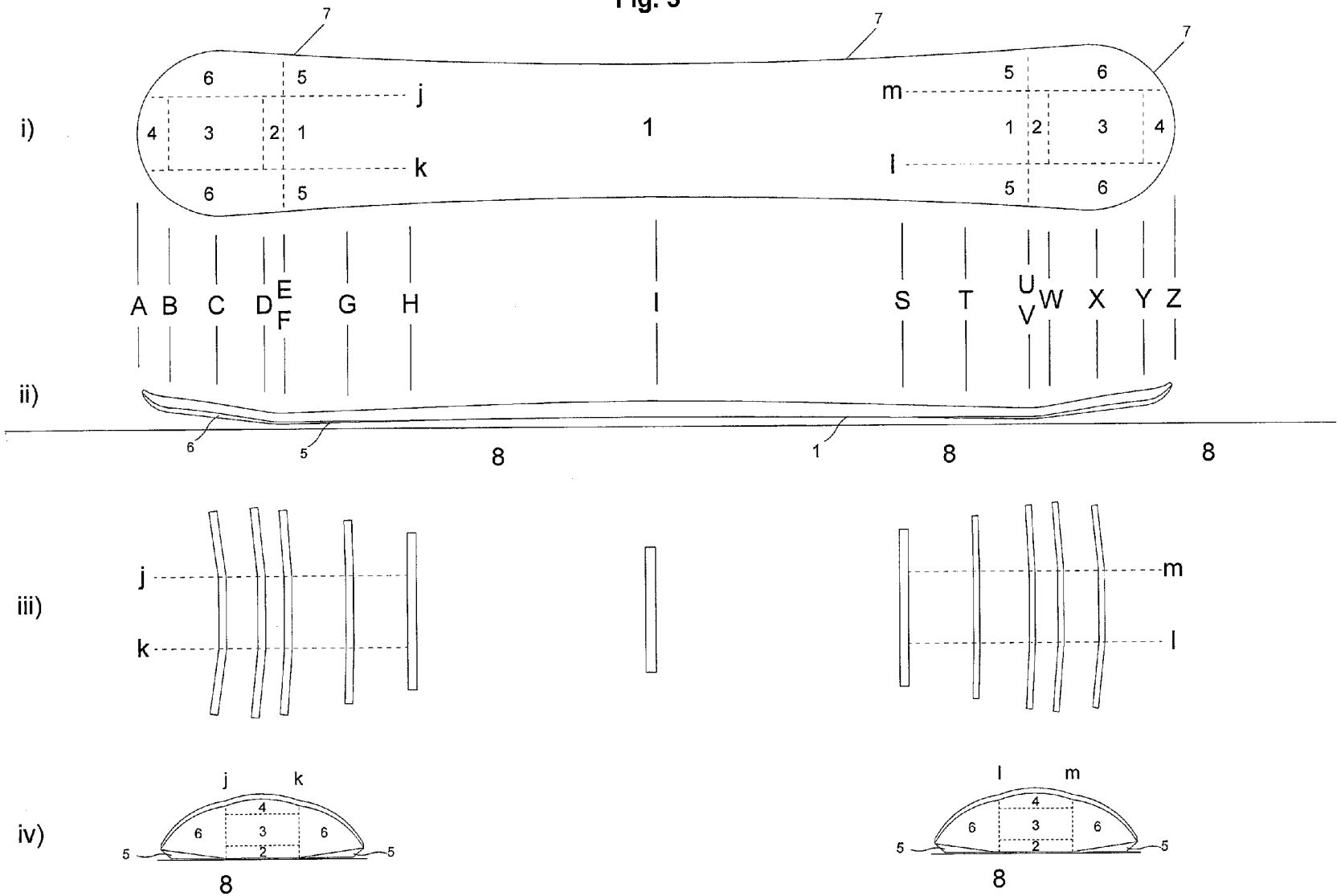
Figure 9:
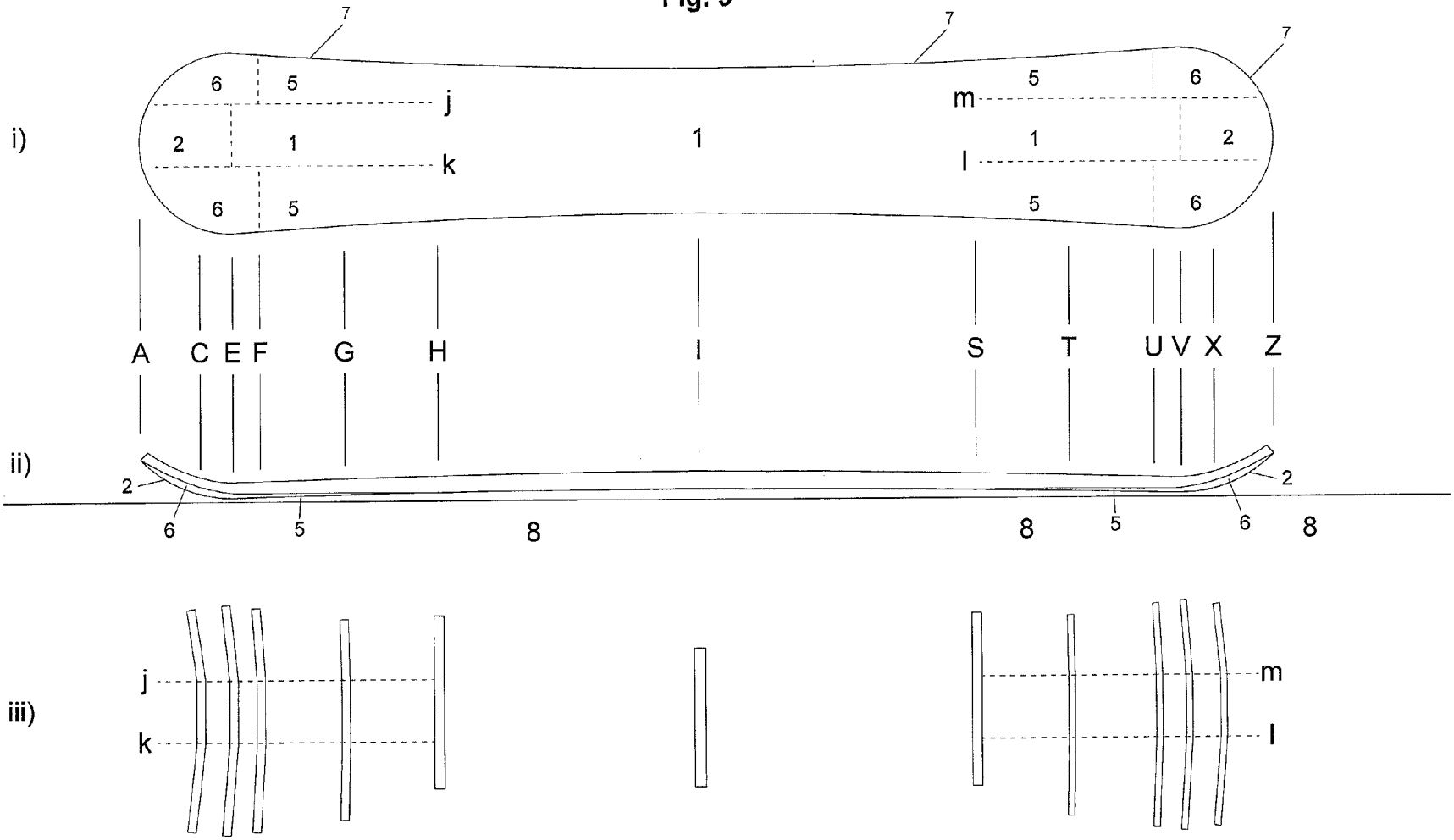
Figure 11:
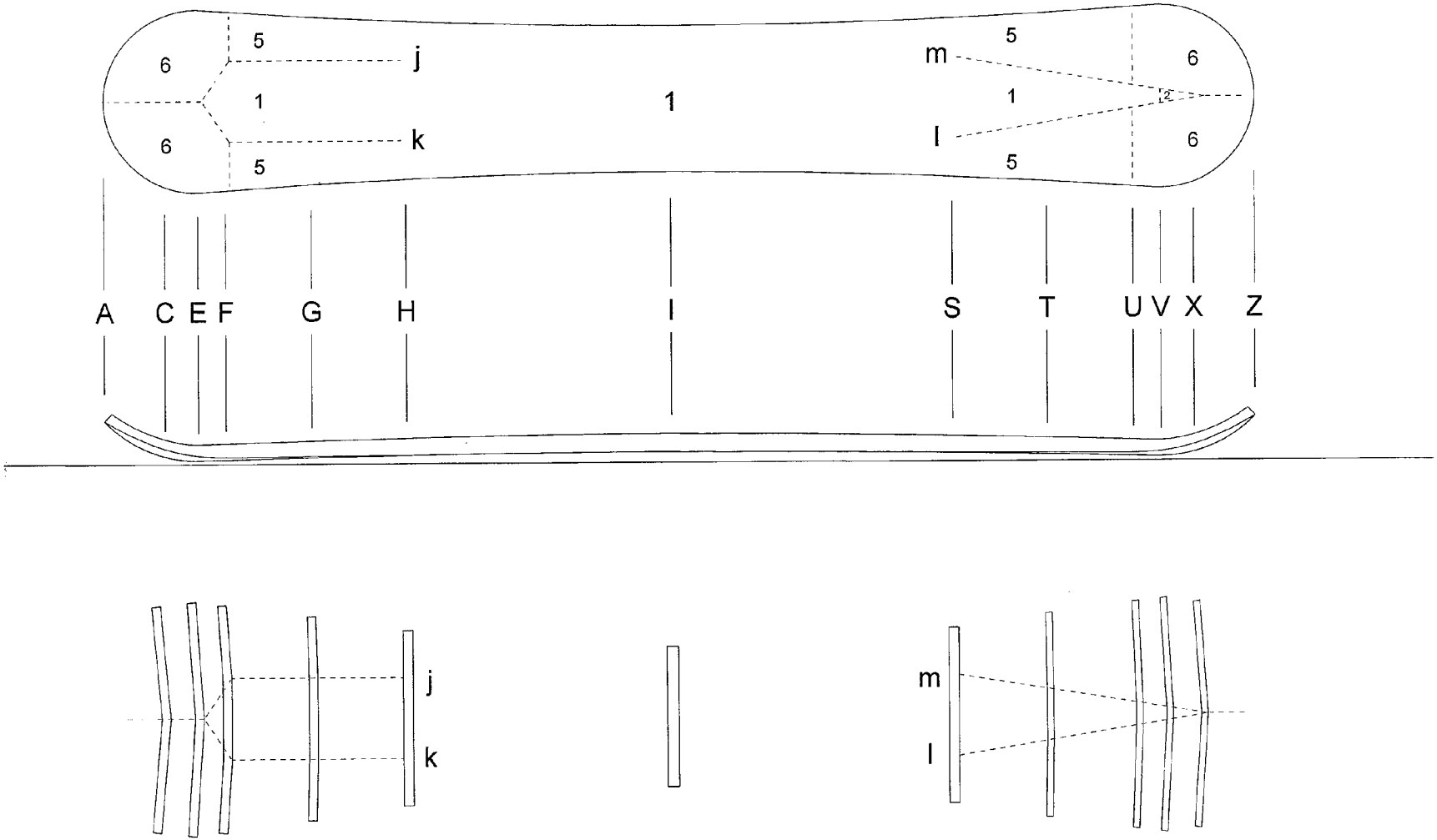
Figure 12:
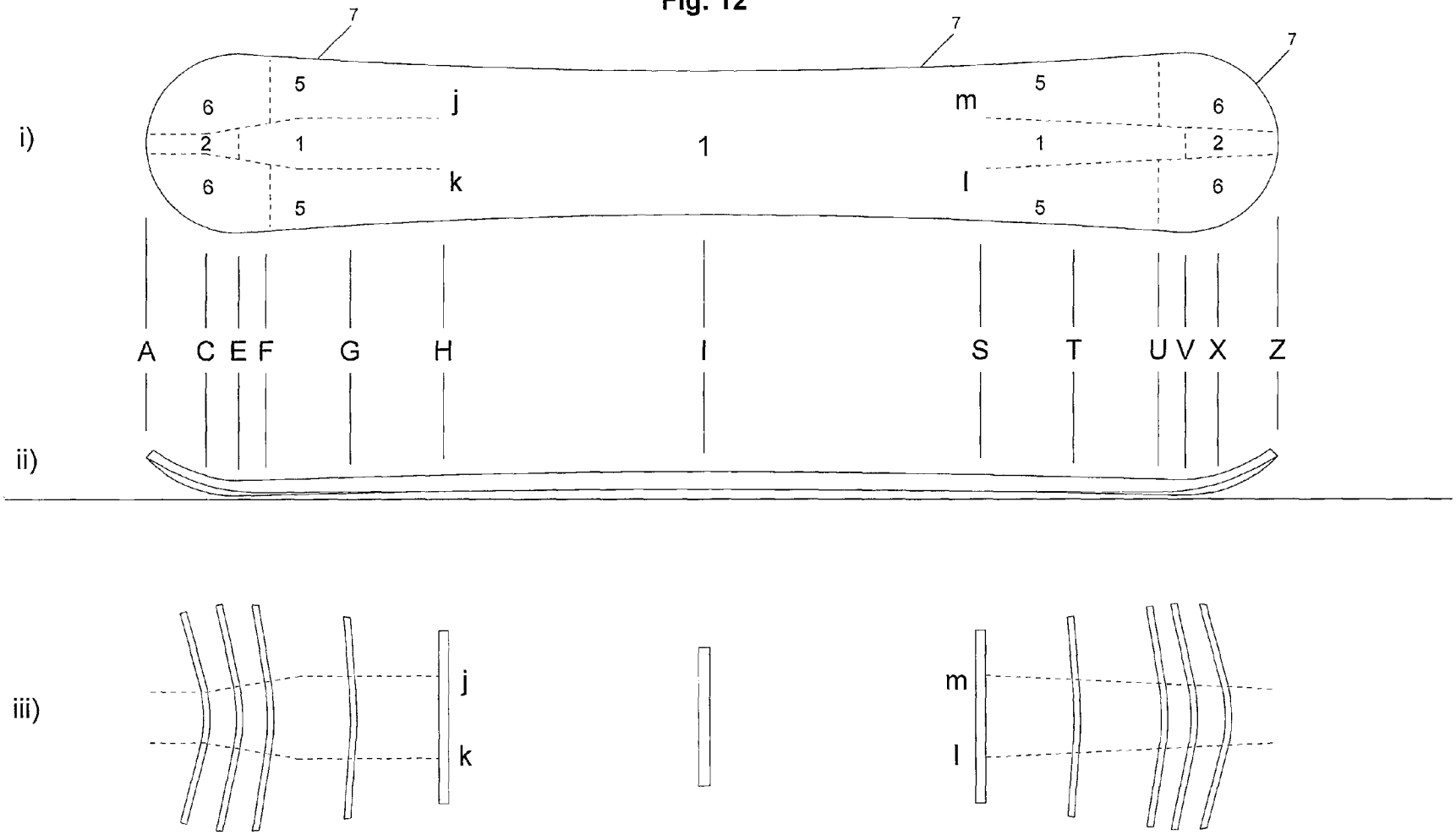

The angle which the raised sliding surfaces (lateral sole surfaces) in the tip forms with the central sole surface cannot be increased too rapidly without creating too abrupt a break upwards in the tip, but this may be improved in two ways: either by combining with a skate plate in the central part of the tip (FIGS. 4 and 5 show two possible examples of this), or by beginning the upward curve to the tip slightly further in towards the middle of the lateral sole surface than in the central sole surface. FIGS. 9, 11 and 12 show possible examples of this, where the transitions F and U between the lateral sole surfaces 5 and 6 are located closer to the middle than the transitions E and V between the first sole surfaces 1 and 2.

Figure 13:
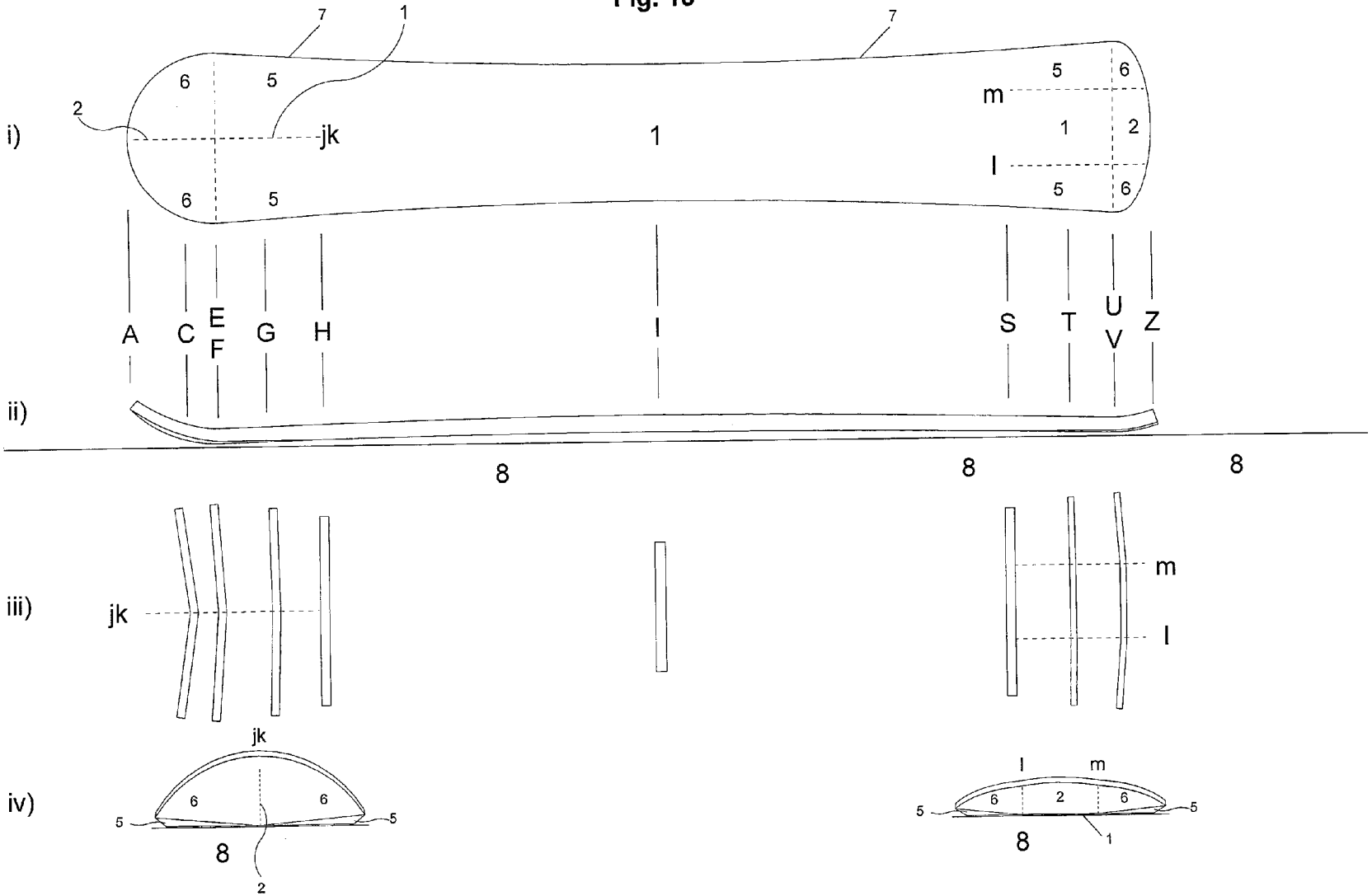

In order to optimise the tip's ability to lift the snowboard up from loose snow during turning, a wider lateral sole surface will increase this functionality. The part of the tip's sole surface, which contacts the snow at a smaller angle than the central sole surface does, increases with a wider lateral sole surface. FIGS. 11, 12 and 13 show examples of wider lateral sole surfaces.

Since there is no essential difference between the front and rear of most snowboards, the board will normally be provided with the same geometry at the front and rear, but without this being an absolute requirement. This type of tip may very well be envisaged in front combined with a sliding surface at the rear which transitions to a normal rear tip without any of the said geometries, and particularly in the case of more directional snowboards this kind of asymmetry is to be expected. Nor do the lines j, k and l, m need to be placed symmetrically about the longitudinal centre line of the board, as one stands asymmetrically on the board.

Figure 3:
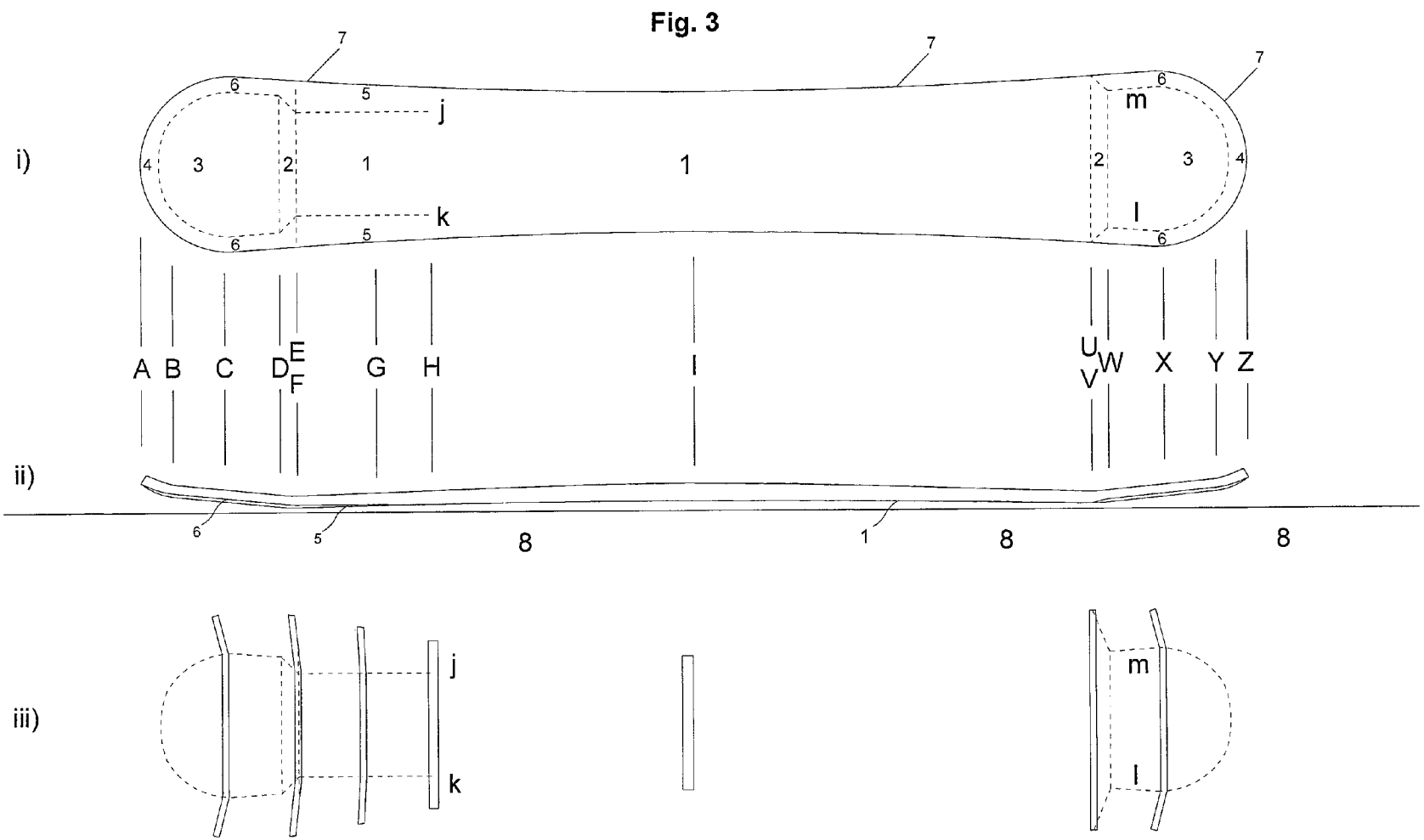
Figure 7:
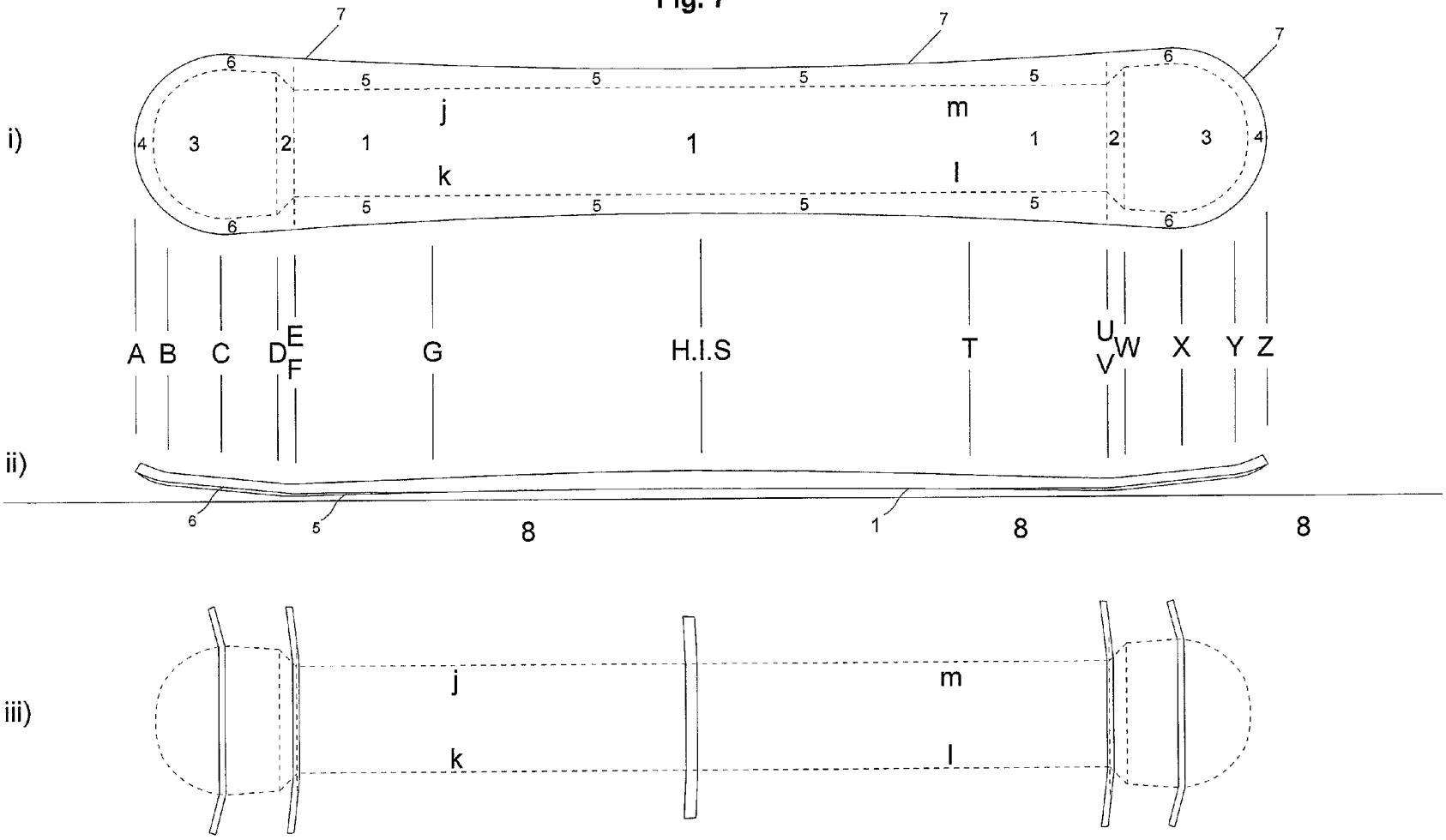

For use on rails the flat skate plate portion should be as wide as possible in order to achieve maximum stability, while the lateral sole surfaces must be wide enough for the steel edge to be raised slightly from the rail, thereby preventing the steel edge from being caught in any small rough patches in the rail. FIGS. 1, 3 and 7 exemplify this point.

The object of the present invention is to provide an improved snowboard specially adapted to achieve increased functionality in loose snow and on rails with a view to performing tricks, which in style and function derive their inspiration from skateboarding. A great many snowboard tricks are performed in low-lying country with a minimum of snow, which in addition is often wet and soft, with the result that lift is important. However, the improved lift described herein may also be employed in powder snow, but in this case the best variant is often to use a wider lateral sole surface than that which is considered optimal on rails and boxes. FIGS. 9-13 exemplify this point. The described functionality is achieved by a snowboard which is characterised by the features which appear in the patent claims.

The present invention solves this special challenge for snowboards by means of the special design of the tip. For using the snowboard flat against the surface, it is the placing of a skate plate as an intermediate piece between the ordinary sole and an additional front tip which provides both increased lift in loose snow as well as the extra functionality intended for use on rails and boxes. The skate plate may be considered to be a part of the tip when riding on snow, and as a functional part of the sole when performing tricks, in comparison with where corresponding tricks have their point of contact on normal snowboards, whether they have regular camber or reversed camber.

DETAILED DESCRIPTION

The present invention will now be described in greater detail by means of embodiments which are illustrated in the drawings. The cross sections show how this functions on snow, where the design of the tips contributes towards better lift and thereby greater speed. It is easy to understand that a wider central sole surface provides greater stability along or across pipes, which are a common type of rails, while it is only when sliding across the rail that a positive safety effect is obtained from the raised steel edges which thereby do not easily become caught in rough patches in the rail. The steel edges are raised because the lateral sliding surfaces and the tip's lateral sole surfaces are curved upwards relative to the central sole surface.

FIG. 1 illustrates a snowboard according to a first embodiment of the present invention, in which i) illustrates the snowboard viewed from the underside, where the snowboard is provided with a skate plate, ii) illustrates the snowboard from the side, where uplift in steel edges is shown in a somewhat exaggerated manner, iii) illustrates a cross section of the snowboard in different transitions, and iv) illustrates the angle between the tip's sole surfaces continued right up to the tip, where the snowboard is viewed from in front.

FIGS. 2-13 illustrate further details and embodiments of the snowboard according to FIG. 1.

FIG. 1 *i*) illustrates the underside of a snowboard with skate plate, where the transition between the central sole surfaces 1, 2, 3 and lateral sole surfaces 5, 6 is depicted by dotted line j, k, l, m. In an area 2 (the area between transitions D and E, F) the tip is curved slightly upwards. A skate plate 3 is marked as area 3, in which case the skate plate 3 extends substantially with a uniform upward gradient. The small front tip is marked by an area 4. Lateral sliding surfaces 5 are arranged along the primary sole surface 1 from transition F some distance in towards the middle of the snowboard (i.e. in towards area I). Outside the skate plate 3 secondary lateral areas 6 are arranged, and in this version we have chosen to let the width of the secondary lateral areas (the lateral sole surfaces) 6 be substantially narrower than the lateral sliding surfaces 5 in order to give the skate plate 3 a larger flat area. ii) shows the snowboard viewed from the side, and under the snowboard a straight line 8 is drawn for the surface, which may be snow, a box or rails. iii) shows a cross section of the snowboard, where it will be noted that steel edges 7 in the cross sections or transitions G, E, C and T, V, X are raised relative to the central portion, while the cross sections or transitions H, I, S depict a flat sole between the steel edges 7.

Figure 2:
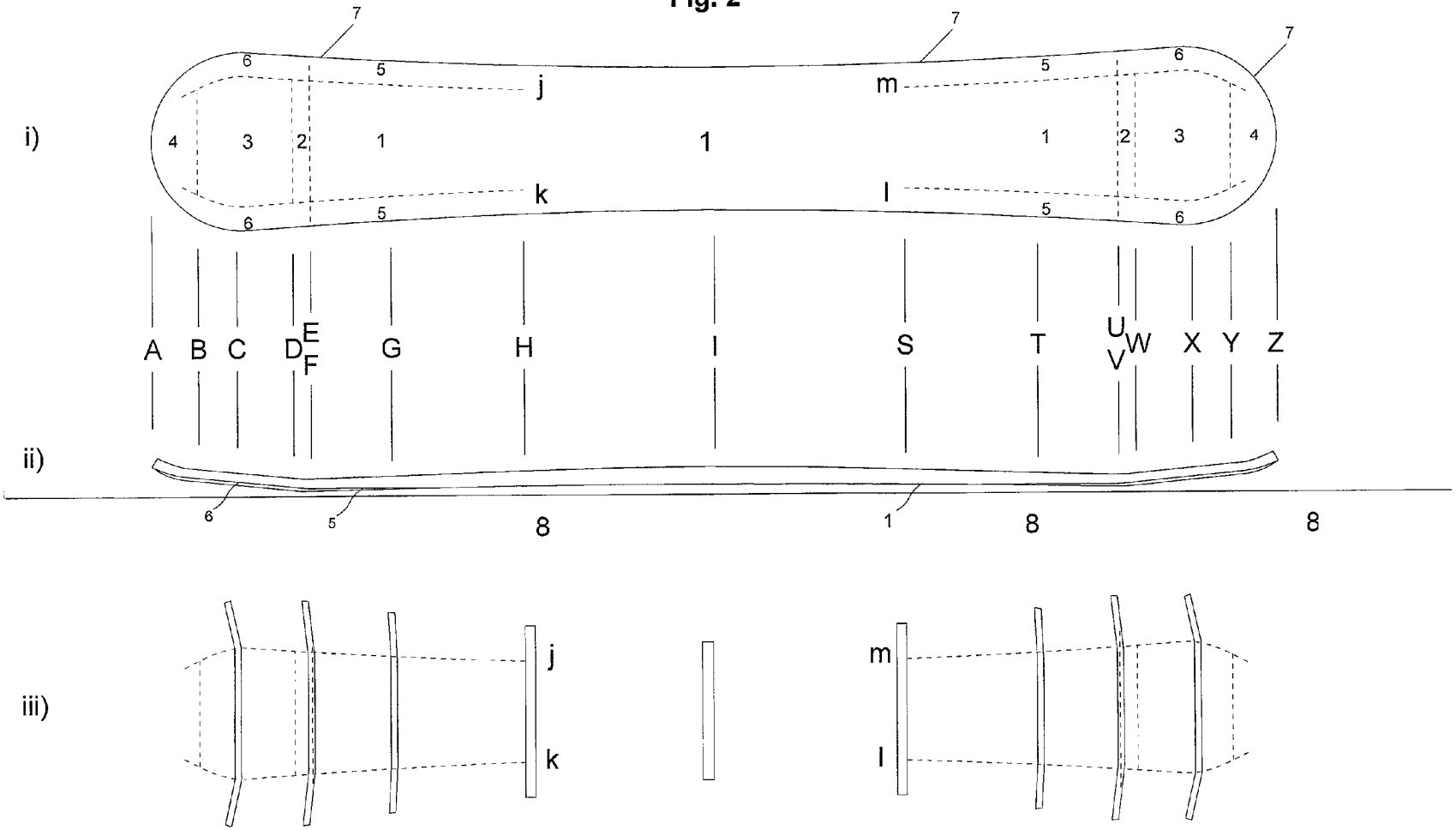

FIG. 2 *i*) illustrates the underside of a snowboard, where the raised lateral areas 5 6 are depicted with approximately constant width. There are secondary lateral areas 5 along the primary sole surface from transition H up to the tip, and correspondingly on the rear half of the board from transition S. Outside the skate plate 3 there are secondary lateral areas 6, and in this version we have chosen to let the secondary lateral areas 5, 6 form an essentially increasing angle with the central sole surfaces 1, 2, 3 all the way from transition H up to transition C, and correspondingly, but inverted on the rear half. This is best seen in the cross sections iii).

FIG. 3 *i*) illustrates the underside of a snowboard, where the transition between the central sole surface 1, 2, 3 and the transition to the secondary lateral areas 5, 6 is depicted by dotted line j, k, l, m. Here the skate plate 3 is slightly longer than in the two preceding examples. It should also be noted that the secondary lateral area 6 is continued round the tip, thereby forming the additional tip 4 in front of the skate plate 3 in a sliding transition from lateral area 6 to front tip 4. There are secondary lateral areas 5 along the primary sole surface 1 from transition E and a distance in towards the middle of the snowboard (i.e. in towards area I). Outside the skate plate 3 secondary lateral areas 6 are arranged, and in this version we have chosen to let the width of lateral area 6 be substantially narrower than lateral area 5 in order to provide the skate plate 3 with a larger flat area. In order to illustrate that it is not necessary to have symmetry at the front and rear, the secondary areas 5 outside the sliding surface are omitted on the rear half.

FIG. 4 *i*) illustrates the underside of a snowboard with a combination of skate plate 3 and an increasing angle from cross section or transition E to C, when viewed in cross section iii), between skate plate 3 and the tip's secondary lateral areas 6. The central sliding surface 1 extends all the way out to the steel edge 7 at transition H, where the sliding surface divides into right and left lateral sliding surface 5 on each side of the central sliding surface 1. From transition H the uplift in the steel edge 7 increases relative to the central sliding surface 1 cautiously accelerating up to transition E, wherefrom the uplift increases more rapidly up to transition C, and from transition C up to the point A the angle is adapted in order to achieve a decent rounding in the tip. The same principle is followed in the rear tip. The angles shown are somewhat exaggerated, but the intention is to demonstrate that with constant width in the lateral areas 5, 6, the angle will increase more rapidly per cm from transition E to C than from transition H to E.

FIG. 5 *i*) illustrates the underside of a snowboard with a combination of a fairly narrow skate plate 3 and a progressively increasing angle between the central sole surfaces 1, 2, 3 and the lateral sole surfaces 5, 6 forwards in the tip from transition E to C. By progressively increasing angle we refer, for example, to the case where the angle increases from 0-3 degrees from transition H-E before increasing from transition E to C by a further 2 degrees, to 5 degrees, on the shorter distance. From transition C to A a uniform uplift is maintained in the steel edge 7 in the forward direction, as illustrated from the front in iv).

Figure 6:
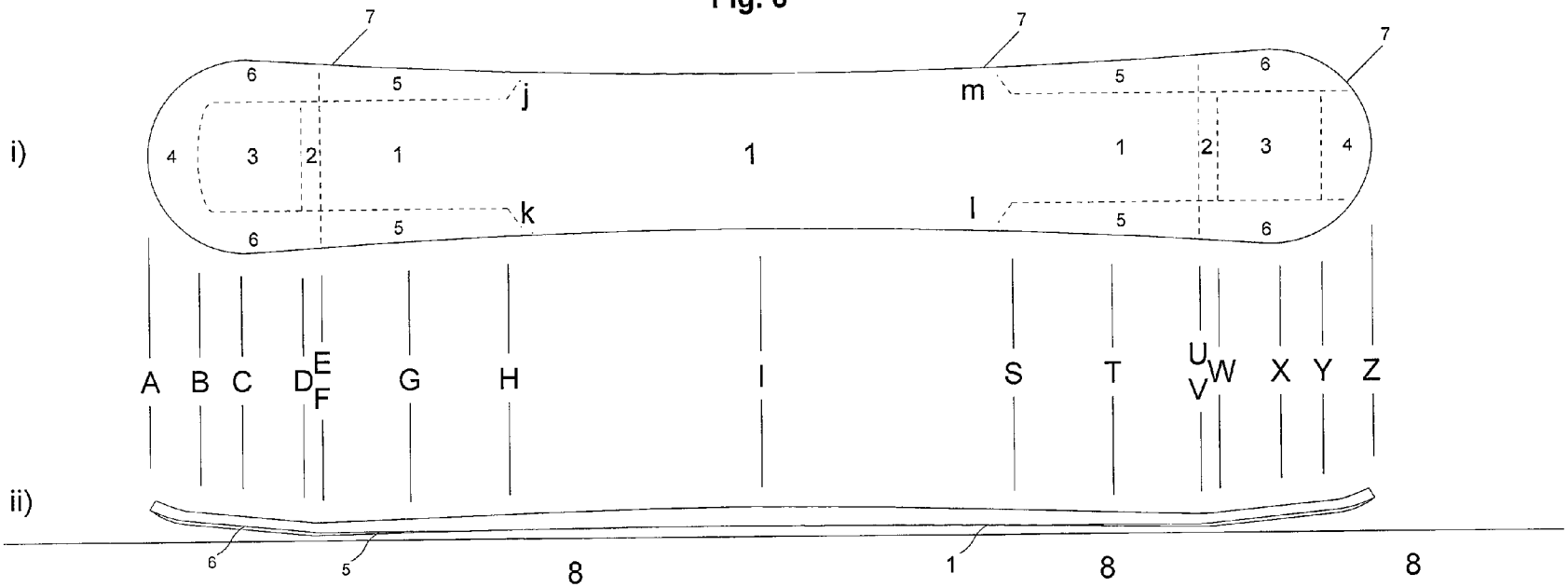

FIG. 6 illustrates two different transitions between lateral area 6 and the front part of the tip 4. At transition B there is a fluent transition between the lateral area 6 and front tip 4, while on the rear part of the board transition Y defines the start of the upward curve of the rear part of the tip 4.

FIG. 7 illustrates a variant with additional lateral areas 5 all the way between transition E and V. In this case moderate uplift of the secondary areas 5 will normally be employed in some areas, in order to retain sufficient edge grip. The uplift in the lateral areas 5 between the bindings is so modest here that it is not shown viewed from the side ii). Skate plate 3 may be envisaged designed here as in all the previously illustrated versions, and a random version has been chosen.

Figure 8:
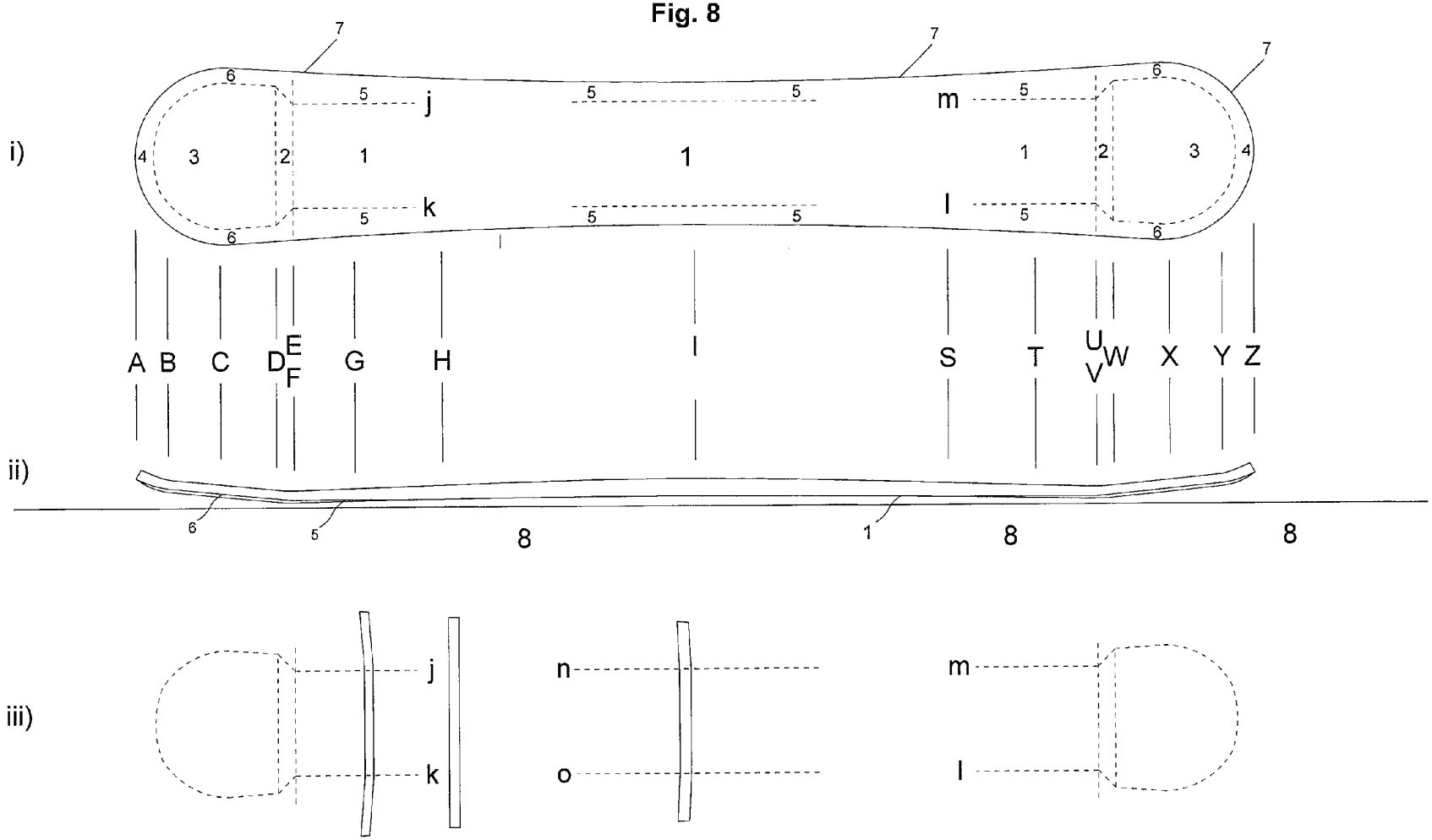

FIG. 8 illustrates an embodiment with additional lateral areas 5 in front of and behind the bindings, see the transitions G and T. The sole is then flat all the way between the steel edges 7 in the area of the bindings, see the transitions H and S, in order to also have normal edge grip there when the snowboard is run flat. Towards the middle of the snowboard there is a narrow, additional lateral area 5 whose function is to raise the steel edges 7 in order to prevent them from being caught in rough patches on rails or boxes, see cross section I.

FIG. 9 illustrates a snowboard according to the invention specially designed for improving lift during turning. The tips have fairly wide lateral sole surfaces 6 and there is a uniform curve upwards in the tip's central sole surface 2 without any skate plate. Viewed in cross section iii) the angle between the tip's central sole surface 2 and the tip's raised lateral sole surfaces 6 increases from the transition F forwards in the tip to approximately halfway up to the point C, and a corresponding process is illustrated in the rear tip (a snowboard of this kind may well be envisaged without any substantial rear tip, or without this functionality in the rear tip). In order to illustrate the increasing angle forwards in the tip, many cross sections are shown, which should only be regarded as examples of one of many ways of increasing the angle outwards from the transition F, U between sliding surface and tip. Left lateral sliding surface 5 is wider than right lateral sliding surface 5 in order to provide more lift on the heel side. This asymmetry is also included in the tips. The sharply increasing lift in the lateral sole surface already begins in transition F and U respectively, even though the tip in the central area begins in transition E and V respectively. The uplift measured in mm in the steel edges 7 relative to the lines j, k increases more rapidly from transition F to C than from transition H to F.

Figure 10:
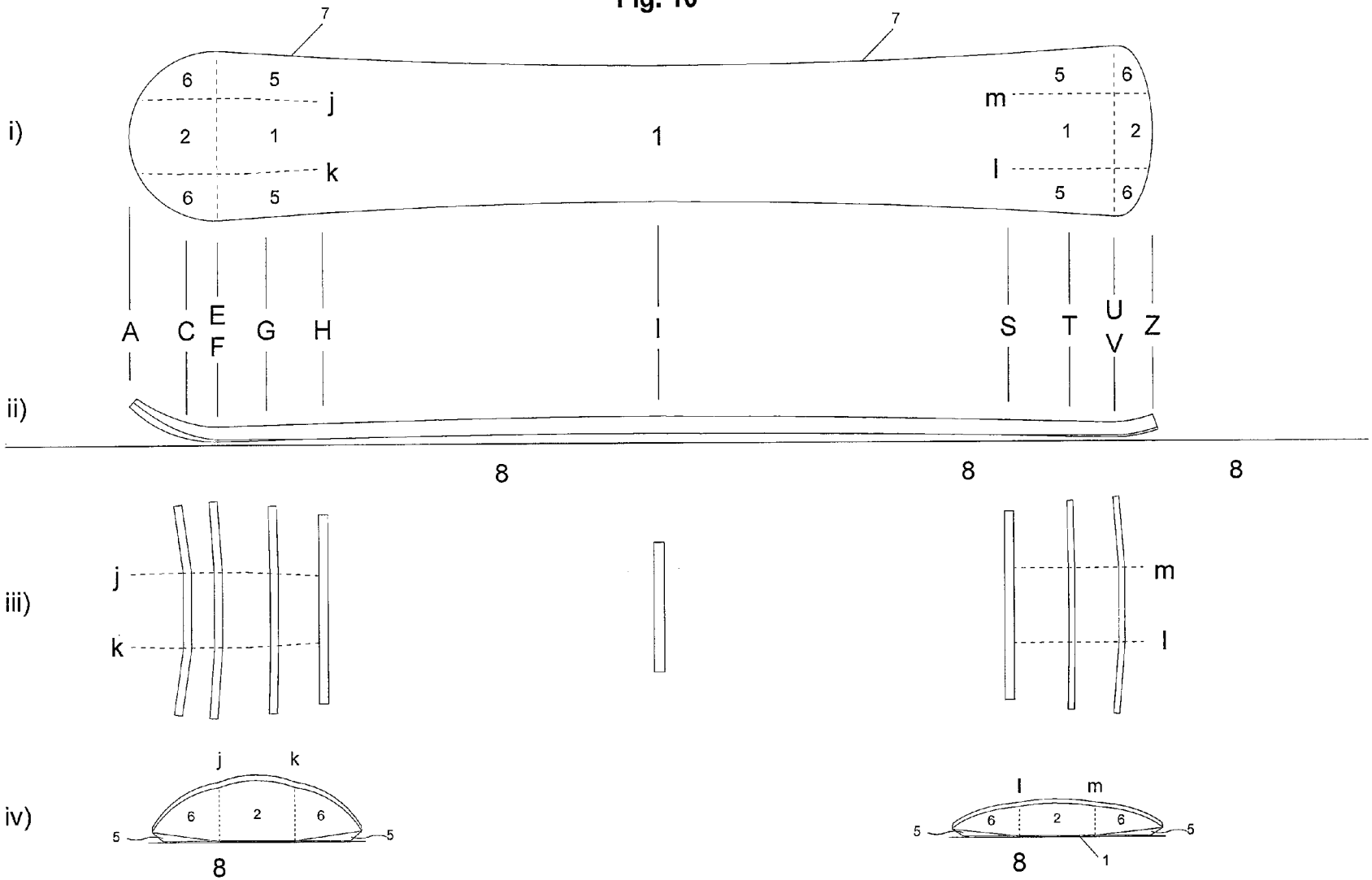

FIG. 10 illustrates a directional snowboard specially designed for improving lift during turning in loose snow. The board has extra wide lateral sole surfaces 5, 6 and a uniform curvature upwards in the tip's central sole surface 2. The transition E, F to the tip is the same between the central sole surfaces 1, 2 and the lateral sole surfaces 5, 6. The angle between the tip's central sole surface and the tip's raised lateral sole surfaces increases from the transition E, F forwards in the tip right to the edge at the front of the tip, with the result that the snowboard's edge in the tip appears with two breaks in the transition between central sole surface 2 and the lateral sole surfaces 6 viewed from in front iv). In this case the rear tip is short and benefits less from an accelerated upward curve of the lateral sole surface behind transition V, but the upward curve in transition V is kept constant backwards, with the result that the rear tip viewed from behind iv) also has two breaks in the upper edge. It is possible, however, to envisage anything from a symmetrically identical rear tip as front tip to more reduced rear tips with or without the special twisting of the lateral sole surfaces from the transition to the tip and outwards. The uplift measured in mm in the steel edges 7 relative to the lines j, k increases more rapidly from transition E to C than from transition H to E.

FIG. 11 illustrates a snowboard specially designed for improving lift during turning. At the front a design of the tip is illustrated where the central sole surface 2 is reduced to a kind of keel forwards in the tip. In order to illustrate the possibilities for variation, a slightly different design is shown behind with slanting transitions and where the central sole area between transition M and L is a slightly rounded keel. The uplift measured in mm in the steel edges 7 relative to the lines increases more rapidly from transition F to C than from transition H to F.

FIG. 12 illustrates a snowboard which has a central sliding surface defined by the flat portion between the bindings and the portion of the board which contacts the surface when the board is pressed against the surface so that the camber is pressed flat and central sliding surface 1 touches the ground from transition E to V. Viewed in cross section the transition between central sliding surface 1 and the secondary lateral sliding surfaces 5 is diffuse, or unclear since the transition is slow via a slight rounding of the central sliding surface 1 where there are lateral sliding surfaces 5. In such cases we define that portions located up to 0.5 mm above the ground when the longitudinal camber is depressed also belong to or are a part of the central sliding surface 1, while portions located more than 0.5 mm above the surface belong to or are a part of the lateral sliding surface 5. The lines j, k, l, m here mark the transition between the sole surfaces 1, 5 according to this definition. The slight curvature in the central sole 1 continues into the tip's central sole surface 2. The dynamic of the snowboard is improved if the sole portions 5 closest to the steel edges are as flat as possible viewed in cross section, and therefore a cross section of the lateral sole surfaces 5 is shown here as straight for the last 2-4 cm nearest the steel edges 7, but a slight curvature does not make such a great difference from the dynamic point of view. The lift measured in mm in the steel edges 7 is measured relative to the middle of the central sliding surface 1, 2 if it is slightly curved. The up lift in the steel edges 7 increases more rapidly from transition F to C than from transition H to F. On the rear half of the snowboard the width of the central sole surface decreases successively backwards as indicated by the lines l, m. The cross sections iii) show a somewhat exaggerated curvature in order for it to be visible on a drawing how this increases from transition H to C and from transition S to X.

FIG. 13 illustrates a snowboard specially designed for improving lift during turning. A design of the sliding surface is shown here where the width of the central sliding surface 1 is reduced to the point on a small break, thereby producing a splitting of the front part of the sliding surface into right and left lateral sliding surface 5 towards the transition E, F to the tip. This splitting continues in the tip, thereby providing a kind of keel forwards towards the point A. This is a directional snowboard, and therefore the same tip function is not required at the rear as at the front, in addition to which the width of the central sliding surface 1 is also almost half the board width towards the transition to the rear tip. The lift measured in mm in the steel edges 7 relative to the lines j, k increases more rapidly from transition E to C than from transition H to E.

The whole underside of a snowboard normally consists of a sole surface, which can be divided into front tip and rear tip and an intermediate sliding surface. Since the present invention assumes the use of a dynamic three-dimensional sliding surface, the sliding surface will be divided into central sliding surface 1 and lateral sliding surfaces 5. The lateral sliding surfaces transition to the tips, but are then described as lateral sole surfaces 6.

DESIGNATIONS IN THE FIGURES i. The underside, the sole of the snowboard illustrated by dotted lines in order to show smooth transitions between different portions ii. The snowboard viewed from the side. The uplift in the steel edge has to be slightly exaggerated here in order to make the point iii. Cross section of the snowboard, slightly enlarged relative to i).

iv. On some snowboards the angle between the tip's sole surfaces is continued right up to the tip, and then the snowboard is viewed from in front in order to illustrate this variant.

1. Primary sliding surface (=central sliding surface)

2. Area where the sole/snowboard is curved upwards forming the central sole surface in the tip, possibly only the first part of the tip if this also consists of a skate plate 3

3. Skate plate, an almost level part of the central sole surface in the tip which always slants slightly upwards, viewed from the side.

4. Front, upwardly curved part of the front tip or correspondingly at the rear.

5. Lateral sliding surfaces between first sliding surface and steel edge 7

6. Lateral sole surfaces between the tip's central sole surface 2, 3, 4 and steel edge 7

7. Steel edges or other hard edges surrounding the snowboard's sole surfaces

8. The surface; a pipe (=a type of rail) or a box or the ground (the snow).

A and Z: Line marking the point on the snowboard

B. and Y: Cross section in the tip. In FIGS. 1-8 the line marks the transition between skate plate 3 and front (rear) part of the small tip 4

C and X: Cross section in the tip

D and W: Cross section in the tip. In FIGS. 1-8 the line marks the transition between skate plate 3 and the upwardly curved area 2

E and V: Cross section marking the transition between the ordinary sliding surface 1 and the tip 2

F and U: Cross section marking the transition between the ordinary lateral sliding surface and the accelerated uplift of the lateral sole surface outwards in the tip G and T: Cross section at a point between binding fastening and the transition to the tip H and S: Mark the point where the primary sliding surface extends right out to the steel edge I. Marks the middle of the board.

In all versions, the skate plate 3 is shown beginning at a line D (W) across the snowboard. There is room for variation here, since this line may also be slightly slanting without causing any substantial changes in the functionality of the skate plate 3, with the result that a slanting transition in D is also covered by the invention. The same applies in the transition B (Y). In the same way the lines j and k need not start at the same point on the right and left sides, even though symmetry of this kind is shown here. The same applies for the lines m and l.

Four tables are now set up illustrating the snowboard according to the present invention with examples of the uplift in the steel edges 7 relative to primary sole surface 1, 2, when viewed in cross section. Uplift and geometry are deliberately varied in order to demonstrate different possibilities within the scope of the invention.

TABLE 01

| Cross Section | | | | | | |
|---|---|---|---|---|---|---|
| A | B | C | D | F | G | H |
| 890 | 248 | 248 | 0 | 0 | 0.00 | |
| 900 | 249 | 249 | 0 | 0 | 0.00 | |
| 910 | 249 | 249 | 0 | 0 | 0.00 | |
| 920 | 250 | 250 | 0 | 0 | 0.00 | The base |
| 930 | 250 | 250 | 0 | 0 | 0.00 | is flat all |
| 940 | 251 | 251 | 0 | 0 | 0.00 | the way |
| 950 | 251 | 251 | 0 | 0 | 0.00 | between |
| 960 | 252 | 252 | 0 | 0 | 0.00 | steel edges |
| 970 | 252 | 252 | 0 | 0 | 0.00 | |
| 980 | 253 | 253 | 0 | 0 | 0.00 | |
| 990 | 253 | 253 | 0 | 0 | 0.00 | |
| 1000 | 254 | 254 | 0 | 0 | 0.00 | |
| 1010 | 254 | 254 | 0 | 0 | 0.00 | |
| 1020 | 255 | 255 | 0 | 0 | 0.00 | |
| 1030 | 256 | 130 | 63 | 0.1 | −0.10 | |
| 1040 | 257 | 130 | 64 | 0.2 | −0.10 | |
| 1050 | 257 | 130 | 64 | 0.3 | −0.10 | Dynamically |
| 1060 | 258 | 130 | 64 | 0.4 | −0.10 | shaped |
| 1070 | 259 | 130 | 65 | 0.5 | −0.10 | secondary |
| 1080 | 260 | 130 | 65 | 0.6 | −0.10 | base surface |
| 1090 | 260 | 130 | 65 | 0.7 | −0.10 | in this area |
| 1100 | 261 | 130 | 66 | 0.8 | −0.10 | |
| 1110 | 262 | 130 | 66 | 1.0 | −0.20 | |
| 1120 | 263 | 130 | 67 | 1.1 | −0.10 | Increased |
| 1130 | 264 | 130 | 67 | 1.2 | −0.10 | uplift towards |
| 1140 | 265 | 130 | 68 | 1.4 | −0.20 | transition to |
| 1150 | 266 | 130 | 68 | 1.5 | −0.10 | the tip |
| 1160 | 267 | 130 | 69 | 1.6 | −0.10 | |
| 1170 | 268 | 130 | 69 | 1.8 | −0.20 | secondary |

TABLE 01-continued

| Cross Section | | | | | | |
|---|---|---|---|---|---|---|
| A | B | C | D | F | G | H |
| 1180 | 269 | 130 | 70 | 1.9 | −0.10 | base surface |
| 1190 | 270 | 130 | 70 | 2.1 | −0.20 | is straight |
| 1200 | 271 | 130 | 71 | 2.2 | −0.10 | seen in |
| 1210 | 272 | 130 | 71 | 2.4 | −0.20 | cross section |
| 1220 | 273 | 130 | 72 | 2.5 | −0.10 | in this area |
| 1230 | 274 | 130 | 72 | 2.7 | −0.20 | |
| 1240 | 275 | 130 | 73 | 2.8 | −0.10 | F-line |
| 1250 | 276 | 130 | 73 | 2.8 | 0.00 | |
| 1260 | 277 | 150 | 64 | 2.8 | 0.00 | Upbend |
| 1270 | 278 | 170 | 54 | 2.8 | 0.00 | radius of |
| 1280 | 279 | 190 | 45 | 2.8 | 0.00 | 330 mm |
| 1290 | 280 | 210 | 35 | 2.8 | 0.00 | G-line |
| 1300 | 281 | 231 | 25 | 2.8 | 0.00 | |
| 1310 | 281 | 231 | 25 | 2.8 | 0.00 | |
| 1320 | 282 | 232 | 25 | 2.8 | 0.00 | |
| 1330 | 282 | 232 | 25 | 2.8 | 0.00 | |
| 1340 | 282 | 232 | 25 | 2.8 | 0.00 | Skate-plate |
| 1350 | 282 | 232 | 25 | 2.8 | 0.00 | 150 mm |
| 1360 | 282 | 232 | 25 | 2.8 | 0.00 | long |
| 1370 | 282 | 232 | 25 | 2.8 | 0.00 | |
| 1380 | 281 | 231 | 25 | 2.8 | 0.00 | |
| 1390 | 279 | 229 | 25 | 2.8 | 0.00 | |
| 1400 | 276 | 226 | 25 | 2.8 | 0.00 | |
| 1410 | 272 | 222 | 25 | 2.8 | 0.00 | |
| 1420 | 267 | 217 | 25 | 2.8 | 0.00 | |
| 1430 | 260 | 210 | 25 | 2.8 | 0.00 | H-line |
| 1440 | 253 | | | | | |
| 1450 | 243 | | This special | | | Tail |
| 1460 | 230 | | upbend of | | | 80 mm long |
| 1470 | 215 | | 2.8 mm follows | | | |
| 1480 | 185 | | around | | | Upbend |
| 1490 | 150 | | the tail | | | radius of |
| 1500 | 80 | | | | | 250 mm |

TABLE 1

| One possible example of a directional snowboard 1620 mm long according to invention | | | | | | | |
|---|---|---|---|---|---|---|---|
| | Total width at E (mm) | Total width at I (mm) | Length E-I (mm) | Length I-V (mm) | Sidecut radius. | | |
| | 305,0 | 250 | 660 | 600 | 7934 | | |
| Distance from the tip (mm) | Total width of the ski (mm) | Width of the primary sole (1,2) surface (mm) | Width of each of the secondary(5,6) sole surfaces (mm) | Uplift of steel edge(7) relative primary sole(1,2) (mm) | Steps of steel edge uplift (mm) | Cross section | Calculated Angle between primary and secondary sole (degrees) |
| 0 | 0 | 0 | | 0 | | A | |
| 30 | 180 | 70 | 55 | 2,00 | | | |
| 60 | 240 | 70 | 85 | 4,50 | −2,50 | | |
| 90 | 270 | 70 | 100 | 7,00 | −2,50 | | 4,02 |
| 120 | 295 | 70 | 113 | 9,50 | −2,50 | | 4,85 |
| 150 | 302 | 70 | 116 | 11,00 | −1,50 | C | 5,44 |
| 180 | 305 | 70 | 118 | 9,50 | 1,50 | E | 4,64 |
| 210 | 300 | 70 | 115 | 8,17 | 1,33 | F | 4,07 |
| 240 | 295 | 70 | 113 | 7,24 | 0,93 | | 3,68 |
| 270 | 291 | 70 | 111 | 6,35 | 0,89 | | 3,30 |
| 300 | 287 | 70 | 108 | 5,51 | 0,84 | | 2,91 |
| 330 | 283 | 70 | 106 | 4,71 | 0,80 | | 2,54 |
| 360 | 279 | 70 | 105 | 3,96 | 0,75 | G | 2,17 |
| 390 | 276 | 70 | 103 | 3,26 | 0,70 | | 1,82 |
| 420 | 272 | 70 | 101 | 2,60 | 0,66 | | 1,47 |
| 450 | 269 | 70 | 100 | 1,99 | 0,61 | | 1,14 |
| 480 | 266 | 70 | 98 | 1,42 | 0,57 | | 0,83 |
| 510 | 264 | 70 | 97 | 0,90 | 0,52 | | 0,53 |
| 540 | 261 | 70 | 96 | 0,42 | 0,48 | | 0,25 |
| 570 | 259 | 259 | 0 | 0 | 0,42 | H | |
| 600 | 257 | 257 | 0 | 0 | | | If each part |
| 630 | 256 | 256 | 0 | 0 | | | of the cross |
| 660 | 254 | 254 | 0 | 0 | | | section of |

TABLE 1-continued

| One possible example of a directional snowboard 1620 mm long according to invention | | | | | | | |
|---|---|---|---|---|---|---|---|
| 690 | 253 | 253 | 0 | 0 | | | the ski's sole |
| 720 | 252 | 252 | 0 | 0 | | | were totally |
| 750 | 251 | 251 | 0 | 0 | | | straight, then |
| 780 | 250 | 250 | 0 | 0 | | | the angle |
| 810 | 250 | 250 | 0 | 0 | | | between |
| 840 | 250 | 250 | 0 | 0 | | I | the primary |
| 870 | 250 | 250 | 0 | 0 | | | sole (1,2) |
| 900 | 250 | 250 | 0 | 0 | | | and the |
| 930 | 251 | 251 | 0 | 0 | | | secondary |
| 960 | 252 | 252 | 0 | 0 | | | sole (5,6) |
| 990 | 253 | 253 | 0 | 0 | | | would |
| 1020 | 254 | 254 | 0 | 0 | | | have these |
| 1050 | 256 | 256 | 0 | 0 | | | theoretical |
| 1080 | 257 | 257 | 0 | 0 | | | figures |
| 1110 | 259 | 259 | 0 | 0 | | S | |
| 1140 | 261 | 90 | 86 | 0,34 | −0,34 | | 0,22 |
| 1170 | 264 | 90 | 87 | 0,72 | −0,38 | | 0,47 |
| 1200 | 266 | 90 | 88 | 1,13 | −0,42 | | 0,74 |
| 1230 | 269 | 90 | 90 | 1,59 | −0,45 | | 1,02 |
| 1260 | 272 | 90 | 91 | 2,08 | −0,49 | | 1,31 |
| 1290 | 276 | 90 | 93 | 2,61 | −0,53 | | 1,61 |
| 1320 | 279 | 90 | 95 | 3,17 | −0,56 | T | 1,92 |
| 1350 | 283 | 90 | 96 | 3,77 | −0,60 | | 2,24 |
| 1380 | 287 | 90 | 98 | 4,41 | −0,64 | | 2,57 |
| 1410 | 291 | 90 | 101 | 5,08 | −0,67 | | 2,90 |
| 1440 | 295 | 90 | 103 | 5,79 | −0,71 | | 3,23 |
| 1470 | 300 | 90 | 105 | 6,54 | −0,75 | U,V | 3,57 |
| 1500 | 300 | 90 | 105 | 7,50 | −0,96 | X | 4,10 |
| 1530 | 290 | 90 | 100 | 7,00 | 0,50 | | 4,02 |
| 1560 | 260 | 90 | 85 | 4,50 | 2,50 | | 3,04 |
| 1590 | 190 | 90 | 50 | 2,00 | 2,50 | | 2,29 |
| 1620 | 0 | 0 | 0 | 0 | 2,00 | Z | |

TABLE 2

| One possible example of a twin tip snowboard 1590 mm long according to invention | | | | | | | |
|---|---|---|---|---|---|---|---|
| Total width at E (mm) | | Total width at I (mm) | | Length E-I (mm) | Length I-V (mm) | Sidecut radius. | |
| 310.0 | | 258 | | 630 | 630 | 7646 | |
| Distance from the tip (mm) | Total width of the ski (mm) | Width of the primary sole (1, 2) surface (mm) | Width of each of the secondary (5, 6) sole surfaces (mm) | Uplift of steel edge (7) relative primary sole (1, 2) (mm) | Steps of steel edge uplift (mm) | Cross section | Calculated Angle between primary and secondary sole (degrees) |
| 0 | 0 | 0 | | 0 | | A | |
| 30 | 180 | 10 | 85 | 2.00 | −2.00 | | |
| 60 | 240 | 20 | 110 | 4.00 | −2.00 | | |
| 90 | 270 | 30 | 120 | 6.00 | −2.00 | | 2.87 |
| 120 | 295 | 40 | 128 | 8.00 | −2.00 | | 3.60 |
| 150 | 305 | 50 | 128 | 8.50 | −0.50 | C | 3.82 |
| 180 | 310 | 60 | 125 | 7.50 | 1.00 | E | 3.44 |
| 210 | 305 | 70 | 118 | 6.45 | 1.05 | F | 3.15 |
| 240 | 301 | 80 | 110 | 5.76 | 0.69 | | 3.00 |
| 270 | 296 | 90 | 103 | 5.11 | 0.66 | | 2.84 |
| 300 | 292 | 100 | 96 | 4.49 | 0.62 | | 2.68 |
| 330 | 288 | 110 | 89 | 3.90 | 0.58 | | 2.51 |
| 360 | 285 | 120 | 82 | 3.36 | 0.55 | G | 2.34 |
| 390 | 281 | 130 | 76 | 2.84 | 0.51 | | 2.16 |
| 420 | 278 | 140 | 69 | 2.37 | 0.48 | | 1.97 |
| 450 | 275 | 150 | 62 | 1.92 | 0.44 | | 1.77 |
| 480 | 272 | 160 | 56 | 1.52 | 0.41 | | 1.55 |
| 510 | 270 | 170 | 50 | 1.15 | 0.37 | | 1.32 |
| 540 | 268 | 180 | 44 | 0.81 | 0.34 | | 1.06 |
| 570 | 266 | 190 | 38 | 0.51 | 0.30 | | |
| 600 | 264 | 200 | 32 | 0.25 | 0.26 | | If each part |
| 630 | 262 | 262 | 0 | 0 | 0.25 | H | of the cross |
| 660 | 261 | 261 | 0 | 0 | | | section of |
| 690 | 260 | 260 | 0 | 0 | | | the ski's sole |

TABLE 2-continued

| One possible example of a twin tip snowboard 1590 mm long according to invention | | | | | | | |
|---|---|---|---|---|---|---|---|
| 720 | 259 | 259 | 0 | 0 | | | were totally |
| 750 | 258 | 258 | 0 | 0 | | | straight, then |
| 780 | 258 | 258 | 0 | 0 | | | the angle |
| 810 | 258 | 258 | 0 | 0 | | | between |
| 840 | 258 | 258 | 0 | 0 | | I | the primary |
| 870 | 258 | 258 | 0 | 0 | | | sole (1, 2) |
| 900 | 259 | 259 | 0 | 0 | | | and the |
| 930 | 260 | 260 | 0 | 0 | | | secondary |
| 960 | 261 | 261 | 0 | 0 | | | sole (5, 6) |
| 990 | 262 | 262 | 0 | 0 | | S | would |
| 1020 | 264 | 190 | 37 | 0.25 | −0.25 | | have these |
| 1050 | 266 | 180 | 43 | 0.51 | −0.26 | | theoretical |
| 1080 | 268 | 170 | 49 | 0.81 | −0.30 | | figures |
| 1110 | 270 | 160 | 55 | 1.15 | −0.34 | | |
| 1140 | 272 | 150 | 61 | 1.52 | −0.37 | | 1.42 |
| 1170 | 275 | 140 | 67 | 1.92 | −0.41 | | 1.63 |
| 1200 | 278 | 130 | 74 | 2.37 | −0.44 | | 1.83 |
| 1230 | 281 | 120 | 81 | 2.84 | −0.48 | T | 2.02 |
| 1260 | 285 | 110 | 87 | 3.36 | −0.51 | | 2.21 |
| 1290 | 288 | 100 | 94 | 3.90 | −0.55 | | 2.38 |
| 1320 | 292 | 90 | 101 | 4.49 | −0.58 | | 2.55 |
| 1350 | 296 | 80 | 108 | 5.11 | −0.62 | | 2.71 |
| 1380 | 301 | 70 | 115 | 5.76 | −0.66 | | 2.87 |
| 1410 | 305 | 60 | 123 | 6.45 | −0.69 | | 3.02 |
| 1440 | 310 | 50 | 130 | 7.18 | −0.73 | U, V | 3.17 |
| 1470 | 305 | 40 | 133 | 7.20 | −0.02 | X | 3.12 |
| 1500 | 300 | 30 | 135 | 7.00 | 0.20 | | 2.97 |
| 1530 | 290 | 20 | 135 | 4.50 | 2.50 | | 1.91 |
| 1560 | 260 | 10 | 125 | 2.00 | 2.50 | | 0.92 |
| 1590 | 0 | 0 | 0 | 0 | 2.50 | Z | |

TABLE 3

| One possible example of a skate plate snowboard 1530 mm long according to invention | | | | | | | |
|---|---|---|---|---|---|---|---|
| Total width at E (mm) | | Total width at I (mm) | | Length E-I (mm) | Length I-V (mm) | Sidecut radius. | |
| 300.0 | | 252 | | 615 | 615 | 7892 | |
| Distance from the tip (mm) | Total width of the ski (mm) | Width of the primary sole (1, 2) surface (mm) | Width of each of the secondary (5, 6) sole surfaces (mm) | Uplift of steel edge (7) relative primary sole (1, 2, 3, 4) (mm) | Steps of steel edge uplift (mm) | Cross section | Calculated Angle between primary and secondary sole (degrees) |
| 0 | 0 | 0 | 0 | 0 | 0.00 | A | |
| 30 | 180 | 170 | 5 | 0.31 | −0.31 | | 3.53 |
| 60 | 240 | 170 | 35 | 2.15 | −1.85 | B | 3.53 |
| 90 | 280 | 170 | 55 | 3.38 | −1.23 | | 3.53 |
| 120 | 295 | 170 | 63 | 3.85 | −0.47 | | 3.53 |
| 150 | 300 | 170 | 65 | 4.00 | −0.15 | C | 3.53 |
| 180 | 295 | 170 | 63 | 3.54 | 0.46 | | 3.24 |
| 210 | 291 | 170 | 61 | 3.11 | 0.43 | | 2.94 |
| 240 | 287 | 170 | 58 | 2.70 | 0.41 | D | 2.64 |
| 270 | 283 | 170 | 57 | 2.31 | 0.39 | | 2.34 |
| 300 | 279 | 170 | 55 | 1.94 | 0.37 | E, F | 2.04 |
| 330 | 276 | 170 | 53 | 1.60 | 0.34 | | 1.73 |
| 360 | 273 | 170 | 51 | 1.28 | 0.32 | | 1.43 |
| 390 | 270 | 170 | 50 | 0.98 | 0.30 | G | 1.13 |
| 420 | 267 | 170 | 49 | 0.71 | 0.27 | | 0.84 |
| 450 | 265 | 170 | 47 | 0.46 | 0.25 | | 0.56 |
| 480 | 262 | 170 | 46 | 0.23 | 0.23 | | |
| 510 | 260 | 260 | 0 | 0 | 0.23 | H | If each part |
| 540 | 258 | 258 | 0 | 0 | | | of the cross |
| 570 | 257 | 257 | 0 | 0 | | | section of |
| 600 | 255 | 255 | 0 | 0 | | | the ski's sole |
| 630 | 254 | 254 | 0 | 0 | | | were totally |
| 660 | 253 | 253 | 0 | 0 | | | straight, then |
| 690 | 253 | 253 | 0 | 0 | | | the angle |
| 720 | 252 | 252 | 0 | 0 | | | between |
| 750 | 252 | 252 | 0 | 0 | | I | the primary |

TABLE 3-continued

| One possible example of a skate plate snowboard 1530 mm long according to invention | | | | | | | |
|---|---|---|---|---|---|---|---|
| 780 | 252 | 252 | 0 | 0 | | | sole (1, 2) |
| 810 | 252 | 252 | 0 | 0 | | | and the |
| 840 | 253 | 253 | 0 | 0 | | | secondary |
| 870 | 253 | 253 | 0 | 0 | | | sole (5, 6) |
| 900 | 254 | 254 | 0 | 0 | | | would |
| 930 | 255 | 255 | 0 | 0 | | | have these |
| 960 | 257 | 257 | 0 | 0 | | | theoretical |
| 990 | 258 | 258 | 0 | 0 | | | figures |
| 1020 | 260 | 260 | 0 | 0 | | | |
| 1050 | 262 | 170 | 46 | 0.23 | −0.23 | S | 0.29 |
| 1080 | 265 | 170 | 47 | 0.46 | −0.23 | | 0.56 |
| 1110 | 267 | 170 | 49 | 0.71 | −0.25 | | 0.84 |
| 1140 | 270 | 170 | 50 | 0.98 | −0.27 | T | 1.13 |
| 1170 | 273 | 170 | 51 | 1.28 | −0.30 | | 1.43 |
| 1200 | 276 | 170 | 53 | 1.60 | −0.32 | | 1.73 |
| 1230 | 279 | 170 | 55 | 1.94 | −0.34 | U, V | 2.04 |
| 1260 | 283 | 170 | 57 | 2.31 | −0.37 | | 2.34 |
| 1290 | 287 | 170 | 58 | 2.70 | −0.39 | W | 2.64 |
| 1320 | 291 | 170 | 61 | 3.11 | −0.41 | | 2.94 |
| 1350 | 295 | 170 | 63 | 3.54 | −0.43 | | 3.24 |
| 1380 | 300 | 170 | 65 | 4.00 | −0.46 | X | 3.53 |
| 1410 | 295 | 170 | 63 | 3.85 | 0.15 | | 3.53 |
| 1440 | 280 | 170 | 55 | 3.38 | 0.47 | | 3.53 |
| 1470 | 240 | 170 | 35 | 2.15 | 1.23 | Y | 3.53 |
| 1500 | 180 | 170 | 5 | 0.31 | 1.85 | | 3.53 |
| 1530 | 0 | 0 | 0 | 0 | 0.31 | Z | |

The angle between soles 3, 4 and 6 is here shown as constant from C to A, causing a double dip in the edge at the tip, as shown in FIG. 5 iv.

TABLE 4

| One possible example of a twin tip snowboard 1500 mm long according to invention | | | | | | | |
|---|---|---|---|---|---|---|---|
| Total width at E (mm) | | Total width at I (mm) | | Length E-I (mm) | Length I-V (mm) | Sidecut radius. | |
| 296.0 | | 249 | | 600 | 570 | 7671 | |
| Distance from the tip (mm) | Total width of the ski (mm) | Width of the primary sole (1, 2) surface (mm) | Width of each of the secondary (5, 6) sole surfaces (mm) | Uplift of steel edge (7) relative primary sole (1, 2) (mm) | Steps of steel edge uplift (mm) | Cross section | Calculated Angle between primary and secondary sole (degrees) |
| 0 | 0 | 0 | 0 | 0 | 0.00 | A | |
| 30 | 180 | 90 | 45 | 1.00 | −1.00 | | 1.27 |
| 60 | 240 | 120 | 60 | 2.50 | −1.50 | | 2.39 |
| 90 | 280 | 140 | 70 | 4.00 | −1.50 | | 3.28 |
| 120 | 291 | 146 | 73 | 4.85 | −0.85 | C | 3.82 |
| 150 | 296 | 148 | 74 | 4.30 | 0.55 | E | 3.33 |
| 180 | 291 | 146 | 73 | 3.60 | 0.70 | | 2.83 |
| 210 | 287 | 144 | 72 | 2.91 | 0.69 | F | 2.32 |
| 240 | 283 | 141 | 71 | 2.49 | 0.41 | | 2.02 |
| 270 | 279 | 140 | 70 | 2.11 | 0.39 | | 1.73 |
| 300 | 275 | 138 | 69 | 1.74 | 0.36 | | 1.45 |
| 330 | 272 | 136 | 68 | 1.40 | 0.34 | G | 1.18 |
| 360 | 269 | 134 | 67 | 1.08 | 0.32 | | 0.92 |
| 390 | 266 | 133 | 66 | 0.79 | 0.29 | | 0.68 |
| 420 | 263 | 132 | 66 | 0.52 | 0.27 | | 0.45 |
| 450 | 261 | 130 | 65 | 0.27 | 0.25 | | 0.24 |
| 480 | 259 | 259 | 0 | 0 | 0.27 | H | |
| 510 | 257 | 257 | 0 | 0 | | | If each part |
| 540 | 255 | 255 | 0 | 0 | | | of the cross |
| 570 | 253 | 253 | 0 | 0 | | | section of |
| 600 | 252 | 252 | 0 | 0 | | | the ski's sole |
| 630 | 251 | 251 | 0 | 0 | | | were totally |
| 660 | 250 | 250 | 0 | 0 | | | straight, then |
| 690 | 249 | 249 | 0 | 0 | | | the angle |
| 720 | 249 | 249 | 0 | 0 | | | between |
| 750 | 249 | 249 | 0 | 0 | | I | the primary |
| 780 | 249 | 249 | 0 | 0 | | | sole (1, 2) |
| 810 | 249 | 249 | 0 | 0 | | | and the |
| 840 | 250 | 250 | 0 | 0 | | | secondary |

TABLE 4-continued

| One possible example of a twin tip snowboard 1500 mm long according to invention | | | | | | | |
|---|---|---|---|---|---|---|---|
| 870 | 251 | 251 | 0 | 0 | | | sole (5, 6) |
| 900 | 252 | 252 | 0 | 0 | | | would |
| 930 | 253 | 253 | 0 | 0 | | | have these |
| 960 | 255 | 255 | 0 | 0 | | | theoretical |
| 990 | 257 | 257 | 0 | 0 | | | figures |
| 1020 | 259 | 259 | 0 | 0 | | | |
| 1050 | 261 | 130 | 65 | 0.27 | −0.27 | S | 0.24 |
| 1080 | 263 | 132 | 66 | 0.52 | −0.25 | | 0.45 |
| 1110 | 266 | 133 | 66 | 0.79 | −0.27 | | 0.68 |
| 1140 | 269 | 134 | 67 | 1.08 | −0.29 | | 0.92 |
| 1170 | 272 | 136 | 68 | 1.40 | −0.32 | | 1.18 |
| 1200 | 275 | 138 | 69 | 1.74 | −0.34 | Y | 1.45 |
| 1230 | 279 | 140 | 70 | 2.11 | −0.36 | | 1.73 |
| 1260 | 283 | 141 | 71 | 2.49 | −0.39 | | 2.02 |
| 1290 | 287 | 144 | 72 | 2.91 | −0.41 | U | 2.32 |
| 1320 | 291 | 146 | 73 | 3.60 | −0.69 | | 2.83 |
| 1350 | 296 | 148 | 74 | 4.30 | −0.70 | V | 3.33 |
| 1380 | 291 | 146 | 73 | 4.85 | −0.55 | X | 3.82 |
| 1410 | 280 | 140 | 70 | 4.00 | 0.85 | | 3.28 |
| 1440 | 240 | 120 | 60 | 2.50 | 1.50 | | 2.39 |
| 1470 | 180 | 90 | 45 | 1.00 | 1.50 | | 1.27 |
| 1500 | 0 | 0 | 0 | 0 | 1.00 | Z | |

It is evident that most types of known shapes for the top of the board may be combined with this invention, which relates substantially to the geometry in the sole surfaces under the board. It may be mentioned that it might be of interest to have a flat top on the board round the bindings, thereby preventing the board's shape from being influenced by the bindings being mounted on the board. Different geometrical structures on the top of or internally in the board in order to increase or reduce stiffness and torsional rigidity may be adapted to suit the described geometry in the sole.

All the models illustrated here are reasonably symmetrical about a centre line drawn along the snowboard. Since a snowboard rider does not stand symmetrically on the board relative to this line, there is no reason to suppose that the ideal snowboard is symmetrical about this line. The functionality in the invention does not depend on such symmetry, with the result that the invention may equally well be implemented with considerable differences between the board's right and left sides.

The invention claimed is:

1. A snowboard comprising a board for mounting two bindings on the board's surface at a distance apart corresponding to approximately ⅓ of the board's length, where the board is provided with inwardly curved edge portions, the board having greater width at both ends at the transition (E, V) to the tips than at the middle (I), wherein the tip includes a skate plat, which during normal running on snow functions as a part of the tip, but which when performing certain tricks functions as a part of a central sliding surface, where the skate plate is located a few cm in front of the ordinary sliding surface in an area (C) between a skate plate (D) and an area (B), and between the beginning of the skate plate (D) and the end of the ordinary sliding surface (E) there is a shorter area where the sole surface is curved upwards, where the skate plate (C) relative to the ordinary sole surface has an approximately straight form so that the skate plate's angle to the surface has essentially a constant rising over the skate plate, where the area (B) in front of the skate plate is curved further upwards in a front tip, with the result that the sole in the front tip creates an increasing angle with the surface again, viewed in the snowboard's longitudinal direction.

2. A snowboard according to claim 1, wherein skate plate is used on the rear half of the snowboard according to the same principles as the front part, even though the design need not be identical.

3. A snowboard according to claim 1, wherein the skate plate is at least 4 cm long between transition (B, D), preferably over 8 cm and most preferred over 12 cm long.

4. A snowboard according to claim 1, wherein the area between D and E where the board is curved upwardly between the sliding surface and skate plate is a maximum of 15 cm long, preferably shorter than 10 cm long, and most preferred shorter than 5 cm long.

5. A snowboard according to claim 1, wherein skate plate forms a mean angle of maximum 12 degrees with the sliding surface, preferably under 9 degrees and most preferred less than 6 degrees and more than 3 degrees.

6. A snowboard according to claim 1, wherein the transition (D) to skate plate starts at least 10 cm in front of the normal position of the bindings, preferably at least 15 cm and most preferred at least 20 cm, and in a corresponding fashion behind the rear binding.

7. A snowboard according to claim 1, wherein between the transitions to front tip E and rear tip V the snowboard is provided with additional sliding surfaces where the steel edges in the lateral sliding surfaces are located higher above the central sliding surface at E and possibly at V than in the middle I.

8. A snowboard according to claim 1, wherein some of the transitions (B, C, D, E, F) between the different areas of the snowboard are not perpendicular to the board's longitudinal direction, nor are they located symmetrically about the longitudinal axis.

9. A snowboard according to claim 1, wherein it is only the front tip which has a special design, and an ordinary rear tip is employed, or even a small or no rear tip.

10. A snowboard comprising a board for mounting two bindings on the board's surface at a distance apart corresponding to approximately ⅓ of the board's length, where the board is provided with inwardly curved edge portions, the board having greater width at both ends at a transition (E, V) to the tips than at the middle (I), wherein a sliding surface of the snowboard has a three-dimensional sliding surface, where the lateral sliding surfaces and thereby also steel edges towards the transition (E) to the tip have an increasing uplift relative to a plane defined by a central sliding surface when it is pressed down against the ground, i.e. when the snowboard is laying flat and without a camber, and then this geometry in the sliding surface is combined with a design of the tip(s), where the tip(s) has lateral sole surface which, when viewed in cross section, give steel edges which are raised relative to the central sole surface of the tip or a lowest part of the tip, when viewed in cross-section, and far advanced forward in the tip(s), and the sliding surface of the snowboard has a three-dimensional sliding surface which is substantially tripartite, with a right lateral sliding surface, a central sliding surface and a left lateral sliding surface towards the transition (E, V) to the tip(s) over a length which at both the ends of the board together form at least 10% of the sliding surface's total length, and wherein the steel edges, when viewed in cross section, create an increasing uplift relative to the central sole surface (1, 2) and (3) or the lowest part of the sole surfaces, the latter representing the extension of the cross section lines of (1, 2) taken into the tip, from the transition (F) between the secondary sliding surface and the tip's lateral sole surface to a cross section (C) located in front of the transition, where the uplift in cross section (C), measured in mm, is at least 25% greater in the transition (F), preferably at least 35% and most preferred at least 50%.

11. A snowboard according to claim 10, wherein the steel edges, viewed in cross section, create an increasing uplift relative to the central sole surface from the transition between sliding surface and tip and a few cm outwards in the tip, with the result that the uplift increases at least 1% of the lateral sole surface's width, and preferably more than 2% from the transition (F) until maximum uplift in the steel edge is achieved in C.

12. A snowboard according to claim 10, wherein the tips' lateral surfaces start further in towards the board's bindings than the transition between the central sliding surface and the tip's central sole surface does in F and possibly U, so that the accelerated upward curve in the steel edge already starts a few cm earlier than the upward curve to the tip from the central sliding surface in E and possibly in V.

* * * * *